US009980041B2

(12) United States Patent
Kawakami et al.

(10) Patent No.: US 9,980,041 B2
(45) Date of Patent: May 22, 2018

(54) ACOUSTIC SYSTEM

(71) Applicant: Nippon Sheet Glass Environment Amenity Co., Ltd., Minato-ku, Tokyo (JP)

(72) Inventors: Fukushi Kawakami, Hamamatsu (JP); Masakazu Kiyama, Minato-ku (JP); Takehisa Okamoto, Minato-ku (JP)

(73) Assignee: Nippon Sheet Glass Environment Amenity Co., Ltd., Minato-ku, Tokyo (JP)

( * ) Notice: Subject to any disclaimer, the term of this patent is extended or adjusted under 35 U.S.C. 154(b) by 650 days.

(21) Appl. No.: 14/315,512

(22) Filed: Jun. 26, 2014

(65) Prior Publication Data

US 2015/0055790 A1 Feb. 26, 2015

Related U.S. Application Data

(63) Continuation of application No. PCT/JP2011/007259, filed on Dec. 26, 2011.

(51) Int. Cl.
*H04R 3/00* (2006.01)
*E04B 1/82* (2006.01)
(Continued)

(52) U.S. Cl.
CPC ..... *H04R 3/002* (2013.01); *E04B 1/8227* (2013.01); *G10K 11/178* (2013.01); *H04R 27/00* (2013.01);
(Continued)

(58) Field of Classification Search
CPC ..... G10K 11/178; H04R 3/002; H04R 2227/007; H04R 27/00; H04R 2410/01;
(Continued)

(56) References Cited

U.S. PATENT DOCUMENTS 4,083,395 A * 4/1978 Romano ..... E06B 3/481 160/199
4,290,332 A * 9/1981 Schoeffling, Jr. ..... E04B 1/8236 181/287
(Continued)

FOREIGN PATENT DOCUMENTS

JP 2190044 A 7/1990
JP 9198091 A 7/1997
(Continued)

OTHER PUBLICATIONS

Davis, Ron and Wickersham, Ron, "Experiments in the Enhancement of the Artist's Ability to Control His Interface with the Acoustic Environment in Large Halls", AES, 51st Convention, pp. 1-23.*
(Continued)

*Primary Examiner* — Davetta W Goins
*Assistant Examiner* — Daniel Sellers
(74) *Attorney, Agent, or Firm* — Sughrue Mion, PLLC

(57) ABSTRACT

An acoustic system includes: a first customer-side microphone; a first counselor-side microphone; a first sound changing unit; a first loudspeaker; a second customer-side microphone; a second counselor-side microphone; and a second loudspeaker. Between the second loudspeaker and the first customer-side microphone, a first sound transmission path is provided. Also, between the second loudspeaker and the first counselor-side microphone, a second sound transmission path is provided. These sound transmission paths have substantially the same length. The first sound signal generated by the first customer-side microphone is made to have a phase substantially opposite to that of the second sound signal generated by the first counselor-side microphone, and the sound signals are added together.

6 Claims, 11 Drawing Sheets

(51) Int. Cl.
*G10K 11/178* (2006.01)
*H04R 27/00* (2006.01)

(52) U.S. Cl.
CPC .... *H04R 2227/007* (2013.01); *H04R 2410/01* (2013.01)

(58) Field of Classification Search
CPC ..... E04B 1/8227; E04B 1/8236; E04B 1/84; E04B 1/8409; E04B 2001/8423
USPC ..... 381/73.1
See application file for complete search history.

(56) References Cited

U.S. PATENT DOCUMENTS

| | | | | |
|---|---|---|---|---|
| 5,418,340 | A * | 5/1995 | Wambolt | E04B 1/8236 181/290 |
| 6,442,909 | B2 * | 9/2002 | Waalkes | A47B 21/06 211/192 |
| 2012/0045070 | A1 * | 2/2012 | Mizuno | G10K 11/1782 381/66 |

FOREIGN PATENT DOCUMENTS

| | | | |
|---|---|---|---|
| JP | 11338480 | A | 12/1999 |
| JP | 200584645 | A | 3/2005 |
| JP | 2005247181 | A | 9/2005 |
| JP | 2006267174 | A | 10/2006 |
| JP | 200890296 | A | 4/2008 |
| JP | 2008103851 | A | 5/2008 |
| JP | 2008209785 | A | 9/2008 |
| JP | 2008233670 | A | 10/2008 |
| JP | 2008233671 | A | 10/2008 |
| JP | 2011123141 | A | 6/2011 |

OTHER PUBLICATIONS

Bussiness Wire, "The McIntosh Laboratory and Grateful Dead Legacy Keeps on Truckin'", Apr. 10, 2012, webpage article, "http://www.businesswire.com/news/home/20120410005509/en/McIntosh-Laboratory-Grateful-Dead-Legacy-Truckin%E2%80%99", pp. 1-4.*

Communication dated Nov. 10, 2015, issued by the Japan Patent Office in corresponding Japanese Application No. 2013-551020.

Kawakami, Fukushi, et al., "Active Field Control in Auditoria," Applied Acoustics, Elsevier Science Publishers Ltd., 1990, vol. 31, p. 47-75.

International Preliminary Report on Patentability dated Jul. 1, 2014, from the International Bureau of WIPO in counterpart International Application No. PCT/JP2011/007259.

International Search Report dated Feb. 14, 2012, from the International Bureau of WIPO in counterpart International Application No. PCT/JP2011/007259.

Communication dated Feb. 4, 2014, from the Japanese Patent Office in counterpart Japanese Application No. 2010145038.

Communication dated Mar. 4, 2014, from the Japanese Patent Office in Japanese Application No. 2010145039.

* cited by examiner

ACOUSTIC SYSTEM

BACKGROUND OF THE INVENTION

1. Field of the Invention

The present invention relates to an acoustic system comprising a sound collecting unit and a sound output unit.

2. Description of the Related Art

As a sound masking device (method), there has been conventionally known the one disclosed in Patent Document 1 (the title of the invention: "SOUND MASKING SYSTEM, AND METHOD AND PROGRAM FOR GENERATING MASKING SOUND") or the one disclosed in Patent Document 2 (the title of the invention: "DEVICE FOR PROTECTION OF SPEECH PRIVACY"), for example. Patent Document 1 only describes using a microphone as a means for picking up sounds in a conversation between speaking persons. Patent Document 2 discloses a speech privacy device.

In a sound transmission path including a microphone and a loudspeaker, when the microphone and loudspeaker are placed in the same space, they certainly form a loop and may sometimes cause acoustic feedback or an echo. Acoustic feedback occurs when a microphone picks up sound from a loudspeaker besides voice of a speaking person or a vocalist. The sound received by the microphone from the loudspeaker is amplified by an amplifier, and further amplified by the loudspeaker. Thereafter, the louder sound is received by the microphone again, amplified by the amplifier, and further amplified by the loudspeaker, causing so-called positive feedback. Such repetitions, i.e., a loop state among the microphone, amplifier, and loudspeaker, will cause a sound recognized as a screech or a boom.

Patent Document 1 states that, when a microphone 30 and a loudspeaker 40 are provided in an acoustic space 20A, a masking sound is generated based on a conversation between users present in the acoustic space 20A, and the generated masking sound is audibly produced in the same acoustic space 20A, so that both the conversation and the masking sound can be overheard in an acoustic space 20B. As a result, it is difficult for users present in the acoustic space 20B to understand the content of the conversation between the users present in the acoustic space 20A. However, in this case, acoustic feedback could occur because the microphone 30 and loudspeaker 40 are provided in the same acoustic space 20A. In this regard, Patent Document 1 proposes that the microphone 30 and loudspeaker 40 be appropriately positioned and appropriate signal processing be performed so that acoustic feedback will not occur.

[Patent Document 1] Japanese Patent Application Laid-open No. 2008-233671

[Patent Document 2] Japanese Patent Application Laid-open No. 2006-267174

[Non-Patent Document 1] F. Kawakami and Y. Shimizu, "Active Field Control in auditoria", Appl. Acoust., 1990, 31, p. 45-47

Patent Document 1 suggests that acoustic feedback be prevented when the microphone 30 and loudspeaker 40 are provided in the same acoustic space. However, such a suggestion sometimes does not suffice to prevent acoustic feedback or echoes. That is all because the aim of the system in Patent Document 1 is positive use of feedback loop by smoothing the frequency response between loudspeakers and microphones.

SUMMARY OF THE INVENTION

The present invention has been made in view of such a problem, and a purpose thereof is to provide an acoustic system that can prevent acoustic feedback or echoes.

One embodiment of the present invention relates to an acoustic system. The acoustic system comprises: a first sound collecting unit configured to receive a sound and generate a sound signal representing the sound; a first sound changing unit configured to change a sound signal generated by the first sound collecting unit; a first sound output unit configured to convert a sound signal changed by the first sound changing unit into a sound and to output the sound to a second area different from a first area where the first sound collecting unit is placed; a second sound collecting unit placed in the second area and configured to receive a sound and generate a sound signal representing the sound; a second sound changing unit configured to change a sound signal generated by the second sound collecting unit; and a second sound output unit configured to convert a sound signal changed by the second sound changing unit into a sound and to output the sound to the first area. Between the first sound output unit and the second sound collecting unit, a first sound transmission path and a second sound transmission path having substantially the same length are provided. A sound signal corresponding to a sound transmitted through the first sound transmission path is made to have a phase substantially opposite to that of a sound signal corresponding to a sound transmitted through the second sound transmission path before the sound signals are added together.

According to this embodiment, a sound signal corresponding to a sound transmitted through the first sound transmission path and a sound signal corresponding to a sound transmitted through the second sound transmission path are substantially cancelled out when the sound signals are transmitted to the second sound changing unit.

Optional combinations of the aforementioned constituting elements, and implementations of the invention in the form of apparatuses, methods, systems, computer programs, and recording media storing computer programs may also be practiced as additional modes of the present invention.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

Figure 1:
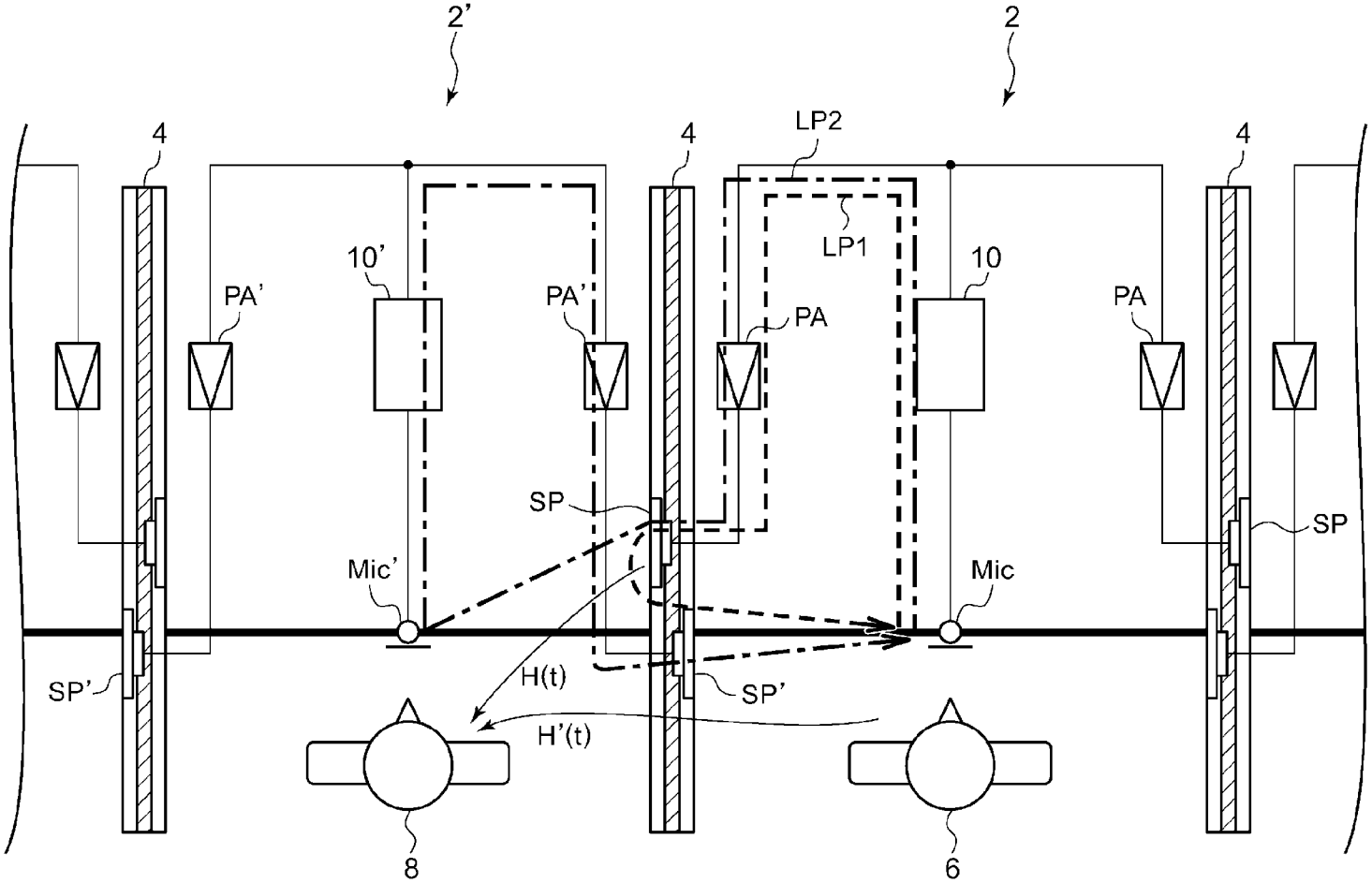
FIG. 1 is a schematic diagram of a booth according to a comparative example.

The invention will now be described by reference to the preferred embodiments. This does not intend to limit the scope of the present invention, but to exemplify the invention.

Like reference characters designate like or corresponding elements, members and processes throughout the views. The description of them will not be repeated for brevity.

FIG. 1 is a schematic diagram of a booth 2 according to a comparative example. The booth 2 is an area separated by partitions 4 and may be a consultation counter in a bank, for example. The booth 2 is provided with a microphone Mic, a sound changing unit 10, two power amplifiers PAs, and two loudspeakers SPs.

A customer 6 having a conversation with a counselor is defined as a speaking person. The voice of the speaking person is collected as maskee (original sound) H'(t) by the microphone Mic provided on the counter or in the vicinity thereof. The maskee H'(t) collected by the microphone Mic is converted into a sound signal and transmitted to the sound changing unit 10. The sound signal is changed by the sound changing unit 10. The sound signal subjected to processing in the sound changing unit 10 is transmitted, via a power amplifier PA, to a loudspeaker SP so as to be converted into a sound. The sound thus converted is output as a processed sound (hereinafter, referred to as masker) H(t) to a neighboring booth 2' provided on either side of the booth 2.

Since the maskee H'(t) travels through the air into the neighboring booth 2', the voice of the customer 6 could be heard by a listener 8 (a person different from the customer 6) present in the neighboring booth 2'. However, in this comparative example, the leaking maskee H'(t) traveling through the air is synthesized with the masker H(t) before being heard by the listener 8 in the neighboring booth 2'. Therefore, because of masking or disturbance by the masker H(t), the listener 8 cannot understand the content of conversation included in the maskee H'(t).

The sound changing process performed by the sound changing unit 10 may be a process of generating noise for a sound period in the maskee H'(t), a process of generating human speech-like (HSL) noise from music or sound instead of noise, or speech deformation (SD), which will be described later. The sound changing unit 10 may be a unit that performs active noise control (ANC) or passive noise control (PNC).

Based on experiences as a person skilled in the art and through preliminary experiments, the inventor has recognized that there are at least two loops, as described below, that could cause acoustic feedback or echoes in a system including the booth 2 and neighboring booth 2' as shown in FIG. 1.

(1) First loop LP1, starting from the microphone Mic following the sound changing unit 10, a power amplifier PA, and a loudspeaker SP, and returning to the microphone Mic The first loop LP1 is indicated by a dotted line in FIG. 1. The sound transmitted from the loudspeaker SP to the microphone Mic is routed around the partition 4.

(2) Second loop LP2, starting from the microphone Mic following the sound changing unit 10, a power amplifier PA, a loudspeaker SP, a microphone Mic', a sound changing unit 10', a power amplifier PA', and a loudspeaker SP', and returning to the microphone Mic The second loop LP2 is indicated by a dashed dotted line in FIG. 1 and is a circulation loop having a shape of a horizontal figure eight.

Conventionally, there has been the idea that, when a sound changing process, such as a process performed by a speech privacy protection device, is provided within a sound loop including a microphone and a loudspeaker, acoustic feedback or an echo is less likely to occur because a sound input to the microphone and a sound output from the loudspeaker have a low correlation. However, the inventor considers that, when the return exceeds 1 in terms of energy, the occurrence of some acoustic feedback phenomenon is a natural logical consequence, though the mode of the phenomenon is different from that of general acoustic feedback. Also, in the preliminary experiments, the inventor has ascertained acoustic feedback and an echo caused by the second loop LP2 as described in the section (2) above. Such acoustic feedback or echoes can be measured and evaluated based on not only the loop gain or open loop gain but also the loop power gain (the ratio of the effective value of the square of the output of Mic when SP is turned on and a loop is formed, to the effective value of the square of the output of Mic when SP is turned off; see Non-Patent Document 1, for example) or the open loop power gain (the average value of the respective squared sound pressures, or the effective value thereof).

In a system including the booth 2 and the neighboring booth 2' as shown in FIG. 1, a voice of a speaking person is picked up and a masking sound {masker H(t)} is provided through the loudspeaker SP so that the voice of the speaking person cannot be heard by a person around the speaking person. Unlike in a large space, such as a gymnasium and a hall, it is often difficult in such a system to implement general measures against acoustic feedback, such as measures for preventing the microphone Mic' from picking up sounds from the loudspeaker SP, because the distance between the speaking person and a person around the speaking person is close and the positional relationship is partly determined.

Also, the first loop LP1 includes a path through which sound is routed around the partition 4, in which large attenuation of sound is caused. Accordingly, the second loop LP2 basically contributes more to acoustic feedback or echoes than the first loop LP1 does.

Therefore, the inventor has created the following embodiments in which acoustic feedback or echoes caused by the second loop LP2 can be restrained in a system including the booth 2 and neighboring booth 2' as shown in FIG. 1.

First Embodiment

Figure 2:
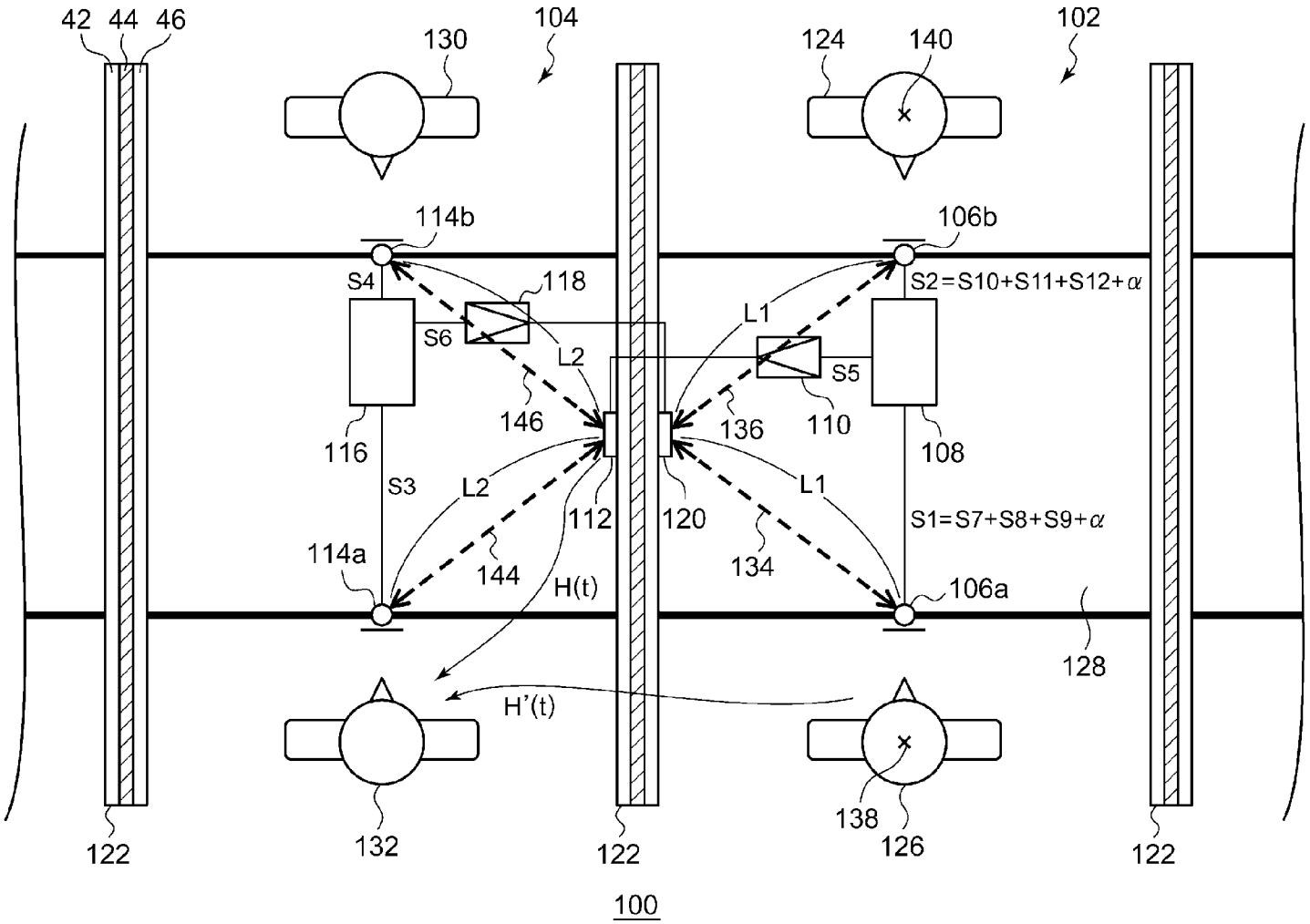
FIG. 2 is a schematic diagram that shows a configuration of an acoustic system according to a first embodiment provided across a first booth and a second booth adjacent to each other.

FIG. 2 is a schematic diagram that shows a configuration of an acoustic system 100 according to a first embodiment provided across a first booth 102 and a second booth 104 adjacent to each other. Each of the first booth 102 and the second booth 104 is an area separated by partitions 122 and may be a consultation counter in a bank, for example. The acoustic system 100 comprises a first customer-side microphone 106*a*, which may be a silicon microphone, a dynamic microphone, a condenser microphone, or the like, a first counselor-side microphone 106*b*, a first sound changing unit 108, a first power amplifier 110, a first loudspeaker 112, a second customer-side microphone 114*a*, a second counselor-side microphone 114*b*, a second sound changing unit 116, a second power amplifier 118, and a second loudspeaker 120.

As the first loudspeaker 112 or the second loudspeaker 120, a loudspeaker capable of providing sound may be employed, and it may be a board loudspeaker, a flat loudspeaker, a cone loudspeaker, or an actuator, for example. In terms of reproduction in the loudspeaker, it is preferable that the loudspeaker has characteristics for providing sound in the range of 50 Hz to 8 kHz, including a voice band, with balance (with a loudspeaker reproducing less sound at 250 Hz or below, the sound masking effect may be reduced because the loudspeaker provides less low-pitched sound).

The first customer-side microphone 106*a* and first counselor-side microphone 106*b* are placed in the first booth 102, and the second customer-side microphone 114*a* and second counselor-side microphone 114*b* are placed in the second booth 104. The second loudspeaker 120 is mounted on a partition 122 so that sound is output within the first booth 102, while the first loudspeaker 112 is mounted on the partition 122 so that sound is output within the second booth 104. The first sound changing unit 108, first power amplifier 110, second sound changing unit 116, and second power amplifier 118 may be placed at any positions, and they may be placed on the back side of the counter 128 in a booth or placed within a partition 122, for example.

The first customer-side microphone 106*a* and the first counselor-side microphone 106*b* are placed on the side of a first customer 126 and on the side of a first counselor 124 of the counter 128, respectively. The first customer-side microphone 106*a* and first counselor-side microphone 106*b* only need to be placed near the respective speaking persons and may be placed on an edge of the desk, on the bottom surface of the desk, or beneath the second loudspeaker 120 on the partition 122, for example. If a microphone is placed on the bottom surface of the desk, a board for efficiently picking up sound may also be placed. The same applies to the second customer-side microphone 114*a* and the second counselor-side microphone 114*b*.

The first customer-side microphone 106*a* and the first counselor-side microphone 106*b* receive a voice of the first customer 126, a voice of the first counselor 124, and a sound output from the second loudspeaker 120, so as to generate a first sound signal S1 and a second sound signal S2, respectively, as electric signals representing the received voice and sound. Similarly, the second customer-side microphone 114*a* and the second counselor-side microphone 114*b* generate a third sound signal S3 and a fourth sound signal S4, respectively.

The first sound changing unit 108 receives the first sound signal S1 and second sound signal S2, changes the signals, and outputs the changed sound signal as a fifth sound signal S5. Similarly, the second sound changing unit 116 receives the third sound signal S3 and fourth sound signal S4, changes the signals, and outputs the changed sound signal as a sixth sound signal S6. The first sound changing unit 108 and second sound changing unit 116 will be detailed later.

The first loudspeaker 112 acquires the fifth sound signal S5 via the first power amplifier 110, converts the acquired sound signal into a sound, and outputs the sound to the second booth 104; similarly, the second loudspeaker 120 acquires the sixth sound signal S6 via the second power amplifier 118, converts the acquired sound signal into a sound, and outputs the sound to the first booth 102.

The first customer 126 having a conversation with the first counselor 124 in the first booth 102 is defined as a speaking person. A voice of the speaking person is collected as maskee H'(t) by the first customer-side microphone 106*a*. The maskee H'(t) collected by the first customer-side microphone 106*a* is converted into a sound signal and transmitted to the first sound changing unit 108. The sound signal is then changed by the first sound changing unit 108. The sound signal subjected to processing in the first sound changing unit 108 is transmitted, via the first power amplifier 110, to the first loudspeaker 112 so as to be converted into a sound. The sound thus converted is then output as masker H(t) within the second booth 104.

Since the maskee H'(t) travels through the air into the second booth 104, the voice of the first customer 126 could be heard by a second counselor 130 or a second customer 132 present in the second booth 104. However, in the present embodiment, the leaking maskee H'(t) traveling through the air is synthesized with the masker H(t) before being heard by the second counselor 130 or second customer 132 in the second booth 104. Therefore, because of masking or disturbance by the masker H(t), the second counselor 130 and second customer 132 cannot understand the content of conversation included in the maskee H'(t).

The partitions 122 have been subjected to acoustic absorption processing. Each of the partitions 122 has a laminated structure, in which a first sound absorbing layer 42, a sound insulating layer 44, and a second sound absorbing layer 46 are laminated in this order. For example, each of the first sound absorbing layer 42 and the second sound absorbing layer 46 may be a glass wool layer with a thickness of 20 mm, and the sound insulating layer 44 may be a gypsum board with a thickness of 12 mm.

When the first customer-side microphone 106*a* and the first counselor-side microphone 106*b* are considered as a sound collecting unit in the acoustic system 100, a first sound transmission path 134 and a second sound transmission path 136, which have substantially the same length L1, are provided between the second loudspeaker 120 and the sound collecting unit. More specifically, the first sound transmission path 134 is provided between the second loudspeaker 120 and the first customer-side microphone 106*a*, and the second sound transmission path 136 is provided between the second loudspeaker 120 and the first counselor-side microphone 106*b*.

The first sound transmission path 134 is the shortest path between the second loudspeaker 120 and the first customer-side microphone 106*a*, which is namely a path obtained by connecting the second loudspeaker 120 and the first customer-side microphone 106*a* with a straight line. Accordingly, among the transmission paths between the second loudspeaker 120 and the first customer-side microphone 106*a*, the first sound transmission path 134 delivers the loudest sound to the first customer-side microphone 106*a*. Namely, a sound delivered to the first customer-side microphone 106*a* through the first sound transmission path 134 is louder than a sound delivered to the first customer-side microphone 106*a* through any other transmission path, which may include reflection by the counter 128 or the partition 122.

Similarly, the second sound transmission path 136 is a path obtained by connecting the second loudspeaker 120 and the first counselor-side microphone 106*b* with a straight line.

The first customer-side microphone 106*a* and first counselor-side microphone 106*b* are placed in the first booth 102 so that the lengths of the sound transmission paths between a position 138 where the first customer 126 supposedly stays in the first booth 102 and the respective microphones are different from each other. Also, the lengths of the sound transmission paths between a position 140 where the first counselor 124 supposedly stays in the first booth 102 and the respective microphones are different from each other.

For example, when the first customer-side microphone 106*a* is to be placed in the first booth 102, there may be assumed a sphere with the second loudspeaker 120 as the center and a radius of L1, and the first customer-side microphone 106*a* may be placed on the sphere surface and near the position 138 of the first customer 126. In other words, the first customer-side microphone 106*a* and the first counselor-side microphone 106*b* are placed so that the distances between the second loudspeaker 120 and the respective microphones are substantially identical (or at positions where physical conditions of the respective microphones with respect to the second loudspeaker 120 become as similar to each other as possible) but the distances between a speaking person and the respective microphones are different from each other (at positions close to the respective speaking persons). The two microphones are then connected in polar character.

The same applies to the relationships between the second customer-side microphone 114*a*, the second counselor-side microphone 114*b*, and the first loudspeaker 112, and a third sound transmission path 144 having a length of L2 is provided between the first loudspeaker 112 and the second customer-side microphone 114*a*, and a fourth sound transmission path 146, also having the length L2, is provided between the first loudspeaker 112 and the second counselor-side microphone 114*b*.

The first sound signal S1 includes a seventh sound signal S7 generated by the first customer-side microphone 106*a* from a sound transmitted through the first sound transmission path 134, an eighth sound signal S8 generated by the first customer-side microphone 106*a* from a voice of the first customer 126, and a ninth sound signal S9 generated by the first customer-side microphone 106*a* from a voice of the first counselor 124.

Similarly, the second sound signal S2 includes a tenth sound signal S10 generated by the first counselor-side microphone 106*b* from a sound transmitted through the second sound transmission path 136, an eleventh sound signal S11 generated by the first counselor-side microphone 106*b* from a voice of the first customer 126, and a twelfth sound signal S12 generated by the first counselor-side microphone 106*b* from a voice of the first counselor 124.

In the acoustic system 100, the first sound signal S1 corresponding to a sound transmitted through the first sound transmission path 134 is made to have a phase substantially opposite to that of the second sound signal S2 corresponding to a sound transmitted through the second sound transmission path 136, and the first sound signal S1 and second sound signal S2 are added together. Since the first sound transmission path 134 and the second sound transmission path 136 have substantially the same length, the seventh sound signal S7 and the tenth sound signal S10 cancel each other out. Similarly, the third sound signal S3 corresponding to a sound transmitted through the third sound transmission path 144 is made to have a phase (polar character) substantially opposite to that of the fourth sound signal S4 corresponding to a sound transmitted through the fourth sound transmission path 146, and the third sound signal S3 and fourth sound signal S4 are added together.

Figure 3:
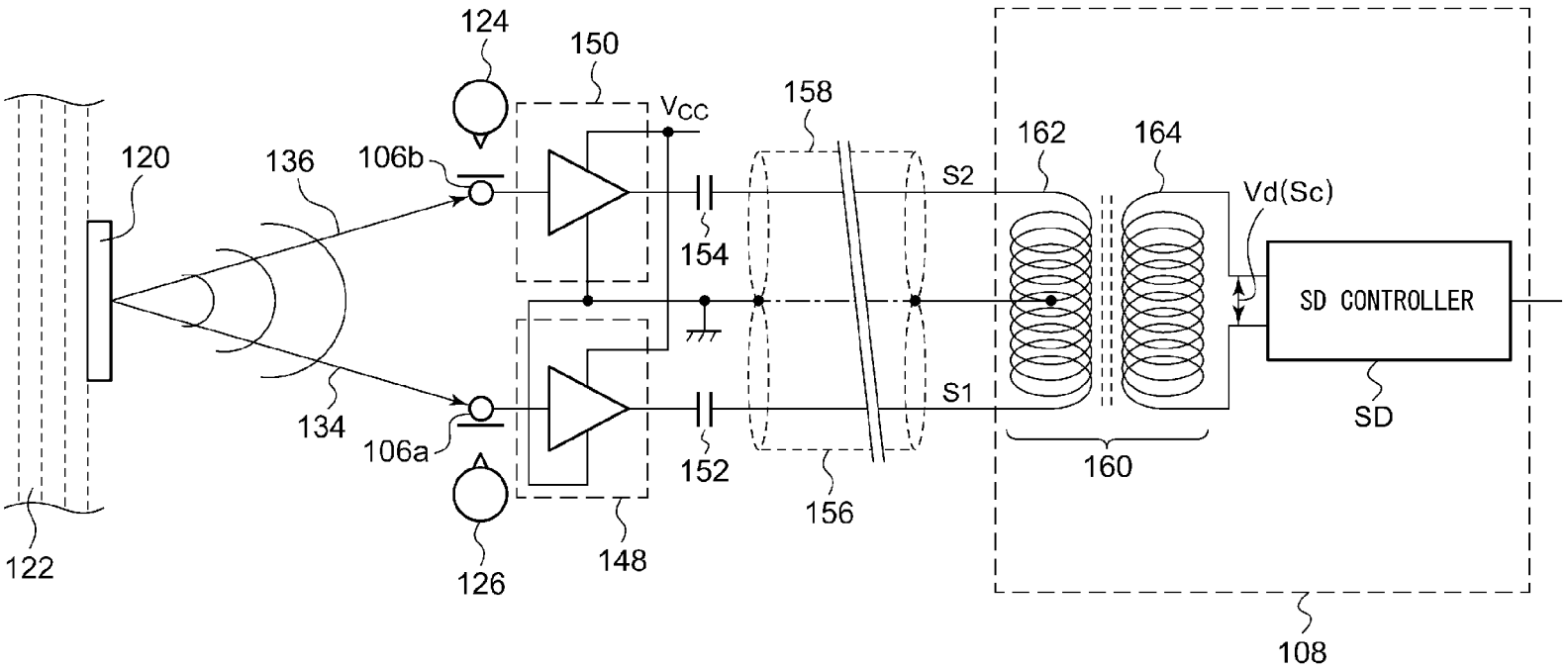
FIG. 3 is a diagram used to describe a flow of a sound and a sound signal from a second loudspeaker to a first sound changing unit shown in FIG. 2.

FIG. 3 is a diagram that shows a flow of a sound and a sound signal from the second loudspeaker 120 to the first sound changing unit 108. The acoustic system 100 comprises a customer-side microphone preamplifier 148, a customer-side coupling capacitor 152, and a customer-side shielded line 156 between the first customer-side microphone 106*a* and the first sound changing unit 108 and also comprises a counselor-side microphone preamplifier 150, a counselor-side coupling capacitor 154, and a counselor-side shielded line 158 between the first counselor-side microphone 106*b* and the first sound changing unit 108.

The customer-side microphone preamplifier 148 and the counselor-side microphone preamplifier 150 amplify and output sound signals generated by the first customer-side microphone 106*a* and the first counselor-side microphone 106*b*, respectively.

The customer-side coupling capacitor 152 and the counselor-side coupling capacitor 154 remove direct-current components from sound signals output by the customer-side microphone preamplifier 148 and the counselor-side microphone preamplifier 150, respectively.

The customer-side shielded line 156 and the counselor-side shielded line 158 transmit, to the first sound changing unit 108, sound signals from which direct-current components have been removed by the customer-side coupling capacitor 152 and the counselor-side coupling capacitor 154, respectively.

The first sound changing unit 108 includes an audio transformer 160 and an SD controller SD. The audio transformer 160 generates a differential sound signal Sc corresponding to a difference between the first sound signal S1 and the second sound signal S2. The SD controller SD changes a differential sound signal thus generated.

One end of a primary winding 162 of the audio transformer 160 is connected to the counselor-side shielded line 158. To the one end of the primary winding 162, the second sound signal S2 from the first counselor-side microphone 106*b* is input. The other end of the primary winding 162 is connected to the customer-side shielded line 156. To the other end of the primary winding 162, the first sound signal S1 from the first customer-side microphone 106*a* is input. The center tap of the primary winding 162 is grounded. Accordingly, the phase of an induced electromotive force caused in a secondary winding 164 by the first sound signal S1 through mutual induction between the primary winding 162 and the secondary winding 164 will be substantially opposite to the phase of an induced electromotive force caused in the secondary winding 164 by the second sound signal S2. Across the secondary winding 164 is generated a voltage equal to the sum of the induced electromotive force caused by the first sound signal S1 and the induced electromotive force caused by the second sound signal S2. Namely, a voltage Vd across the secondary winding 164 corresponds to the difference between the first sound signal S1 and the second sound signal S2. The voltage Vd is input to the SD controller SD. The differential sound signal Sc is a signal having the voltage Vd across the secondary winding 164 as a voltage.

Since the differential sound signal Sc corresponds to the difference between the first sound signal S1 and the second sound signal S2, the seventh sound signal S7 and the tenth sound signal S10 cancel each other out and make a relatively small contribution to the differential sound signal Sc. Meanwhile, since the distance from the first customer 126 to the first counselor-side microphone 106*b* is much larger than the distance from the first customer 126 to the first customer-side microphone 106*a*, the eleventh sound signal S11 is much smaller than the eighth sound signal S8. Similarly, the ninth sound signal S9 is much smaller than the twelfth sound signal S12. Consequently, the differential sound signal Sc mainly contains the eighth sound signal S8 and the twelfth sound signal S12.

The first customer-side microphone 106*a* and first counselor-side microphone 106*b* receive a sound from the second loudspeaker 120 with substantially the same phase and substantially the same amplitude, because the distances between the second loudspeaker 120 and the respective microphones are identical. Also, since the microphones are connected in opposite phases, the sound signals based on the sound from the second loudspeaker 120 are cancelled out and input to the SD controller SD, so that the synthesized signal is finally minimized. However, with regard to a voice of a speaking person input to the first customer-side microphone 106*a* and the first counselor-side microphone 106*b*, the sound signals based on the voice have a low correlation because the distances between the speaking person and the respective microphones are different. Accordingly, the sound signals are input to the SD controller SD without being decreased or cancelled out.

It is assumed here that sound waves having a wave length l, a period T, and an amplitude A are transmitted from a sound source S to two microphones P1 and P2. When SP1=d1 and SP2=d2, the two sound waves are expressed as follows.

$$y = A\sin 2\pi\left(\frac{t}{T} - \frac{d1}{\lambda}\right) \quad (S \rightarrow P1) \qquad \text{[Math. 1]}$$

$$y = A\sin 2\pi\left(\frac{t}{T} - \frac{d2}{\lambda}\right) \quad (S \rightarrow P2)$$

The distances between the sound source S and the two microphones are identical, i.e., d1=d2, and the sound waves have the same wave length l, the same period T, and the same amplitude A. When the two microphones are connected in opposite phases, the sum of the input signals to the microphones can be expressed as follows.

$$\text{Input signal to microphone 1} \quad y_1 = A\sin 2\pi\left(\frac{t}{T} - \frac{d1}{\lambda}\right) \qquad \text{[Math. 2]}$$

$$\text{Input signal to microphone 2} \quad y_2 = -A\sin 2\pi\left(\frac{t}{T} - \frac{d2}{\lambda}\right)$$

$$\begin{aligned} y_1 + y_2 &= A\left\{\sin 2\pi\left(\frac{t}{T} - \frac{d1}{\lambda}\right) - \sin 2\pi\left(\frac{t}{T} - \frac{d2}{\lambda}\right)\right\} \\ &= 2A\sin\left(\frac{d1 - d2}{\lambda}\pi\right)\cos 2\pi\left(\frac{t}{T} + \frac{d1 + d2}{2\lambda}\right) \end{aligned}$$

Since d1=d2, the following formula holds.

$$2A\sin\left(\frac{d1 - d2}{\lambda}\pi\right) = 0 \qquad \text{[Math. 3]}$$

Therefore, the sum of the input signals is expressed as follows.

$$y_1 + y_2 = 0 \qquad \text{[Math. 4]}$$

In this way, by transmitting signals input to the two microphones through the connections between the microphones and the transformer, the signals from the first customer-side microphone 106*a* and the first counselor-side microphone 106*b* having phases opposite to each other are input to the SD controller SD. Accordingly, the sounds from the second loudspeaker 120 are cancelled out. However, a signal based on a voice of a speaking person is input to the SD controller SD without being decreased or cancelled out. Also, the space in each booth surrounded by the partitions is acoustically a minimal space, and most of sounds input from the loudspeaker to the microphones are direct sounds and primary or initial reflected sounds, rather than reflected sounds and reverbetion sounds within the whole room; accordingly, the cancelling as stated above is rationally performed.

Although there has been described the case of using a transformer to obtain signals having opposite phases, such signals may be generated by using an electronic circuit, such as an operational amplifier (op-amp).

Thus, with the present means, the direct sound of a voice of a customer or a counselor is picked up and transformed to be efficiently transmitted to a neighboring booth, while sounds from a loudspeaker are decreased or cancelled out (minimized) through two microphones placed near the customer and counselor; therefore, echoes or acoustic feedback caused by a loop of a so-called horizontal figure eight shape can be effectively prevented. Especially, the minimization of the sounds from the loudspeaker as mentioned above is performed twice while the sounds travel through the loop once; consequently, signals transmitted through the loop will be reduced to near zero.

There will now be described the SD controller SD.

In an office or the like, it is desirable that only audio information, or the content of speech, is masked without impairing openness provided in an open-plan space or smoothness of communication. However, in a conventional technique using background music or masking, a sound with properties different from those of the original sound is basically created in a different process and added irrespective of the original sound, thereby sometimes increasing auditory incongruity and background noise in the room. In the present embodiment, on the other hand, the structure of a sound signal itself collected by a microphone or the like is changed substantially in real time, so that the content of conversation, ideally only that, is masked without increasing background noise in the room, providing smooth and comfortable privacy environments.

The present embodiment is based on the fact that human speech recognition (HSR) is strongly dependent on articulation (which is vocalization and the movement of speech organs in phonetics, or inflection information including intonation, and which means here a time variation in an envelope of a signal excluding a carrier), such as transition of an envelope, rather than on the carrier (carrier wave) of a sound signal. First, an envelope (which is obtained by averaging a waveform of squared sound pressure with a time constant between 5 milliseconds and hundreds of milliseconds or taking the square root thereof, and which has a so-called envelope waveform that changes with time according to the strength of the sound) of maskee is extracted. In the envelope, "substantially one hill of energy envelope", ascending and then descending by about 5 dB or more, is defined as a unit of processing, and, in each of the units, the carrier is replaced by another acoustic signal, such as noise based on the maskee, accumulated original voice of the speaking person, modulated noise, "helium voice", and voice of another person of the same or opposite gender.

Since the envelope of the processed sound (hereinafter, referred to as masker) thus generated is almost identical with the envelope of the maskee, intonations of the masker and maskee become similar to each other, and a listener who listens to the masker and maskee substantially in real time hardly feels incongruity. In addition, since there is no incongruity or a small auditory difference between the masker and maskee and since the content of the maskee is masked in the masker, the listener cannot distinguish or understand the both sounds, and the auditory sense of the listener is made confused, in a manner of speaking. Accordingly, the content of conversation can be effectively masked and prevented from leaking.

Figure 4:
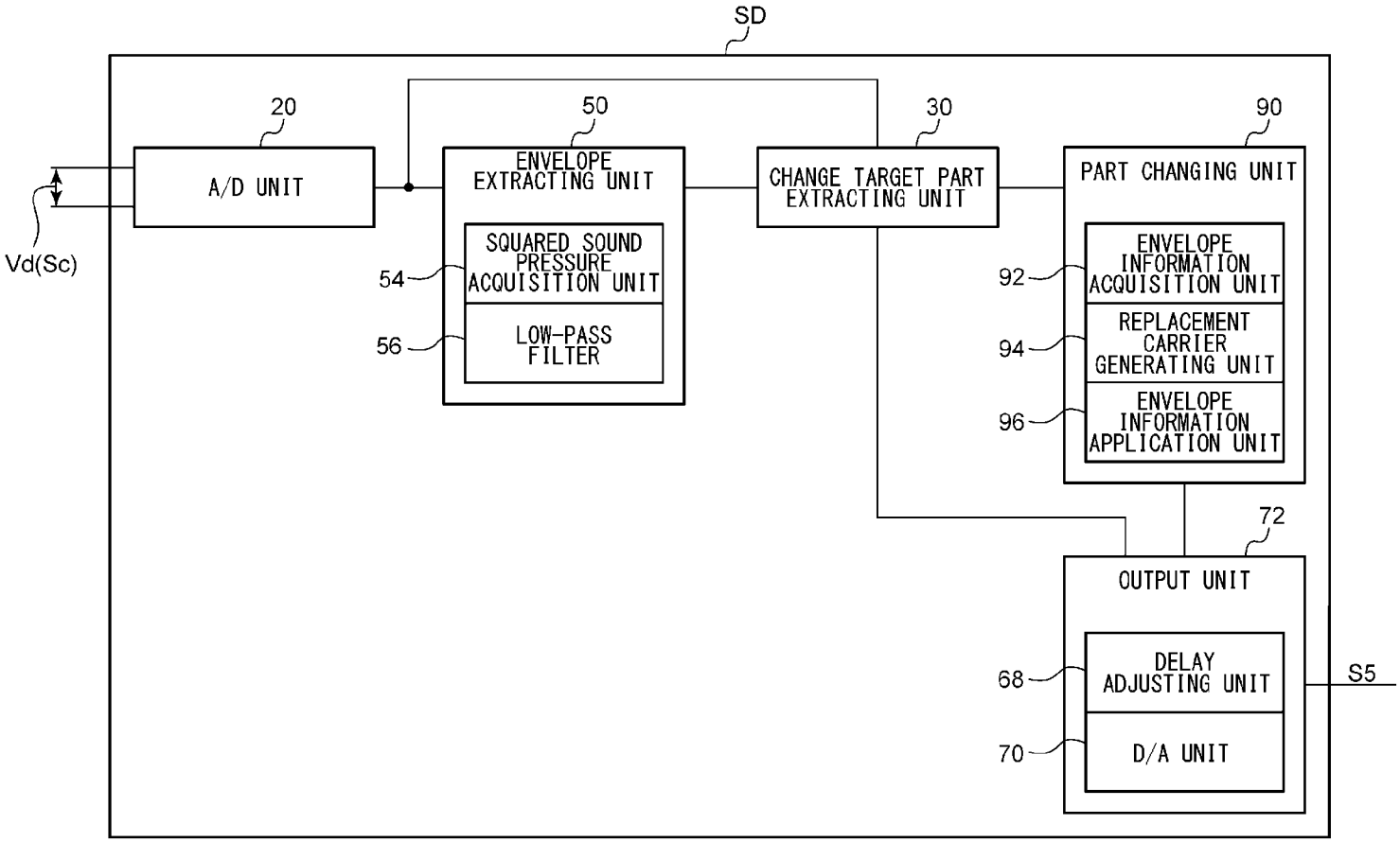
FIG. 4 is a block diagram that shows the functions and configuration of an SD controller shown in FIG. 3.

FIG. 4 is a block diagram that shows the functions and configuration of the SD controller SD shown in FIG. 3. The SD controller SD may include a storage apparatus, such as a hard disk and memory. It will be obvious to those skilled in the art who have found the present specification that each block can be implemented by a CPU, an installed application program module, a system program module, a memory for temporarily store data read out from a hard disk, or the like, which are not illustrated, based on the description of the present specification.

The SD controller SD comprises an A/D unit 20, an envelope extracting unit 50, a change target part extracting unit 30, a part changing unit 90, and an output unit 72.

A differential sound signal Sc (voltage Vd) is input to the A/D unit 20. The A/D unit 20 then converts the differential sound signal, which is an analog signal, into digital data. The differential sound signal digitized in the A/D unit 20 may be digital data in which a voltage value corresponding to the magnitude of a sound pressure is related to a time, for example.

The differential sound signal Sc is a sound signal that can be described as an amplitude-modulated signal. More specifically, this sound signal can be described in the form of the product of an amplitude component, which changes with time at relatively low frequencies, and a carrier component, which changes at relatively high frequencies. In the following, it will be assumed that an envelope is defined as a line representing a time variation of an amplitude component, or a waveform of an amplitude component along a time axis.

The envelope extracting unit 50 extracts, from a differential sound signal digitized in the A/D unit 20, data representing the envelope of the signal. The data may be digital data in which a voltage value corresponding to an amplitude component is related to a time, for example. In the following, data representing an envelope will be simply referred to as an envelope. The envelope extracting unit 50 includes a squared sound pressure acquisition unit 54 and a low-pass filter 56.

The squared sound pressure acquisition unit 54 acquires a squared sound pressure waveform of a differential sound signal digitized in the A/D unit 20. The squared sound pressure acquisition unit 54 acquires a squared sound pressure waveform by squaring a differential sound signal and multiplying a certain factor thereby, as needed.

The low-pass filter 56 averages a squared sound pressure waveform acquired by the squared sound pressure acquisition unit 54, with a time constant between a few milliseconds and hundreds of milliseconds. Namely, the low-pass filter 56 performs low-pass filtering on a squared sound pressure waveform. Accordingly, a variation in a time shorter than the time constant is removed from the squared sound pressure waveform, obtaining a smooth waveform based on a time variation of the amplitude component. The low-pass filter 56 may take the square root of data after the low-pass filtering, as needed.

It will be obvious to those skilled in the art who have found the present specification that the envelope of a differential sound signal may be obtained by other methods, such as averaging absolute values of a carrier, raising a carrier to an even power and taking the average, and obtaining an envelope using the Hilbert transform.

Based on the form of the envelope extracted by the envelope extracting unit 50, the change target part extracting unit 30 extracts a portion from a differential sound signal digitized in the A/D unit 20 and designates the portion as a change target part signal. An envelope of a differential sound signal often has a form of separate hills continuously formed. The change target part extracting unit 30 designates substantially one hill of energy envelope therein as a change target part.

The change target part extracting unit 30 detects, in an envelope of a differential sound signal obtained using the low-pass filter 56, an ascending part continuously ascending by a few dB or tens of dB, such as 5 dB or more. Subsequently, the change target part extracting unit 30 detects a descending part continuously descending by a few dB or tens of dB, such as 5 dB or more, posterior to the ascending part. The change target part extracting unit 30 then designates the signal between the ascending part and the relevant descending part as a change target part signal. The envelope of a change target part signal thus designated often has a form of substantially one hill of energy envelope.

Figure 5A:
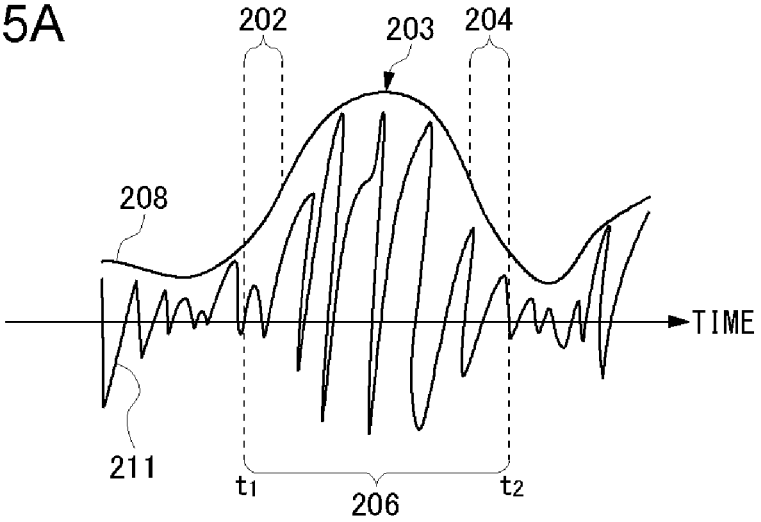
FIG. 5A is a diagram used to describe criteria for determination of a change target part signal performed by a change target part extracting unit shown in FIG. 4.
Figure 5B:
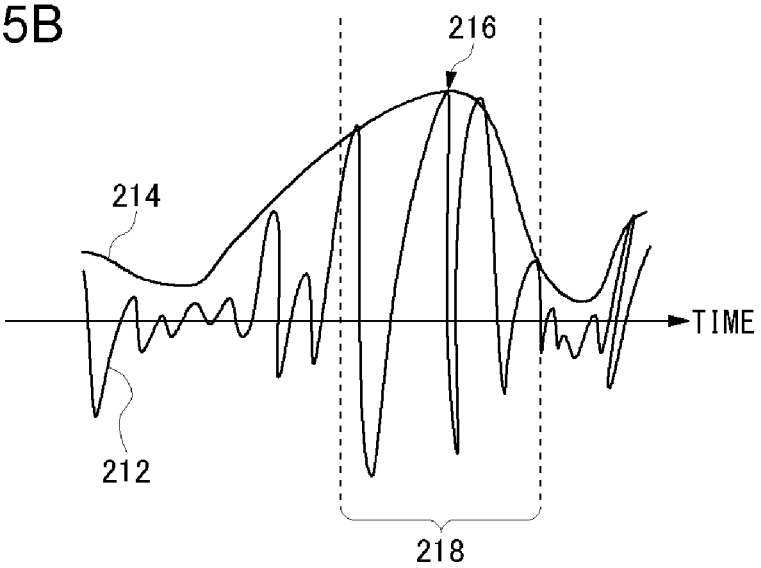
FIG. 5B is a diagram used to describe criteria for determination of a change target part signal performed by a change target part extracting unit shown in FIG. 4.
Figure 5C:
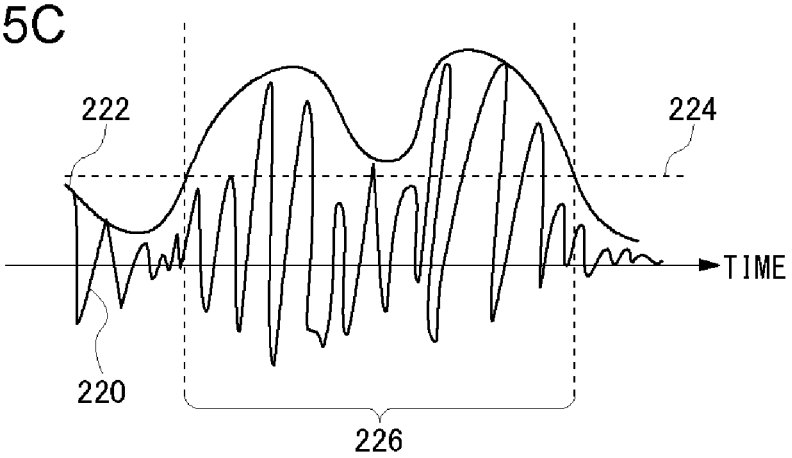
FIG. 5C is a diagram used to describe criteria for determination of a change target part signal performed by a change target part extracting unit shown in FIG. 4.

FIGS. 5A, 5B and 5C is a diagram that shows criteria for determination of a change target part signal performed by the change target part extracting unit 30. FIG. 5A is a diagram that shows the case where the change target part extracting unit 30 determines a change target part signal based on the detection of an ascending part and a descending part. FIG. 5A shows a waveform 211 of a differential sound signal and an envelope 208 thereof as an example. The change target part extracting unit 30 detects an ascending part 202 based on a variation in the envelope 208. Subsequently, the change target part extracting unit 30 detects a descending part 204 posterior to the ascending part 202. The change target part extracting unit 30 then designates the signal in a section 206 between the ascending part 202 and the descending part 204 (a section delimited by a time t1 before a peak 203 and a time t2 after the peak 203) as a change target part signal.

The change target part extracting unit 30 may determine a change target part signal by other methods. For example, the change target part extracting unit 30 may detect a bulging part in an envelope and designate a signal corresponding to the bulging part as a change target part signal. Alternatively, the change target part extracting unit 30 may detect a peak in an envelope and designate a signal within a section including the peak and a predetermined length before and after the peak as a change target part signal. Alternatively, the change target part extracting unit 30 may detect a section in which the envelope continuously exceeds a predetermined level and designate the signal within the section as a change target part signal.

FIG. 5B is a diagram that shows the case where the change target part extracting unit 30 determines a change target part signal based on the detection of a peak. FIG. 5B shows a waveform 212 of a differential sound signal and an envelope 214 thereof as an example. The change target part extracting unit 30 detects a peak 216 in the envelope 214. The change target part extracting unit 30 then designates a signal within a section 218 including the peak 216 and a predetermined length before and after the peak 216, as a change target part signal.

FIG. 5C is a diagram that shows the case where the change target part extracting unit 30 determines a change target part signal based on the level of an envelope. FIG. 5C shows a waveform 220 of a differential sound signal and an envelope 222 thereof as an example. The change target part extracting unit 30 detects a section 226 in which the envelope 222 continuously exceeds a predetermined level 224 and designates the signal within the section 226 as a change target part signal. In this case, the change target part signal may include two or more peaks depending on how to determine the predetermined level.

As stated above, there are various methods for determining a change target part signal. Such many options favorably provide greater flexibility for enabling more effective masking of conversation by means of SD.

A feature common to such various determination methods is determining a portion in a differential sound signal based on the waveform of the signal, especially the statistical features thereof, and designating the portion thus determined as a change target part signal. Namely, a change target part is adaptively determined according to an input differential sound signal. Based on experiences as a person skilled in the art and through preliminary experiments, the inventor has found that, in the case stated above, the content of conversation can be disturbed more effectively and the processed sound includes less incongruity and is more natural, compared to the case where a differential sound signal is partially extracted at predetermined intervals, for example. Particularly, experiments performed by the inventor have found that, in the case where substantially one hill of energy envelope is extracted from an envelope as a unit to be changed, the disturbing effect is higher and the processed sound includes less incongruity and is more natural, compared to the case where a signal is partially extracted at predetermined intervals or the case where a consonant or a vowel is used as a unit to be changed, for example.

The description will now return to FIG. 4.

The change target part extracting unit 30 outputs a part of the differential sound signal that has not been designated as a change target part signal, to a delay adjusting unit 68.

The part changing unit 90 prepares another carrier component different from the carrier component of a change target part signal extracted by the change target part extracting unit 30 and applies the envelope of the change target part signal to the another carrier component, so as to obtain a new change target part signal. The another carrier component used here may be a carrier component independent of the carrier component of the change target part signal extracted by the change target part extracting unit 30 or a carrier component derived therefrom. Examples of the former case are noise based on the maskee H'(t), accumulated original voice of the speaking person, modulated noise, and voice of another person of the same or opposite gender, and an example of the latter case is "helium voice".

The part changing unit 90 repeatedly performs the aforementioned processing for each change target part signal extracted by the change target part extracting unit 30 and outputs the processed signal to the delay adjusting unit 68.

The part changing unit 90 includes an envelope information acquisition unit 92, a replacement carrier generating unit 94, and an envelope information application unit 96. The envelope information acquisition unit 92 acquires, from a change target part signal extracted by the change target part extracting unit 30, information on the envelope of the signal. The replacement carrier generating unit 94 generates a replacement carrier that is different from the carrier component of a change target part signal extracted by the change target part extracting unit 30. The envelope information application unit 96 applies information on an envelope acquired by the envelope information acquisition unit 92 to a replacement carrier generated by the replacement carrier generating unit 94. The part changing unit 90 outputs, to the delay adjusting unit 68, a new change target part signal obtained after the application of envelope information.

There will now be described the case where a part changing unit 90' uses noise based on maskee H'(t) as another carrier component.

Figure 6:
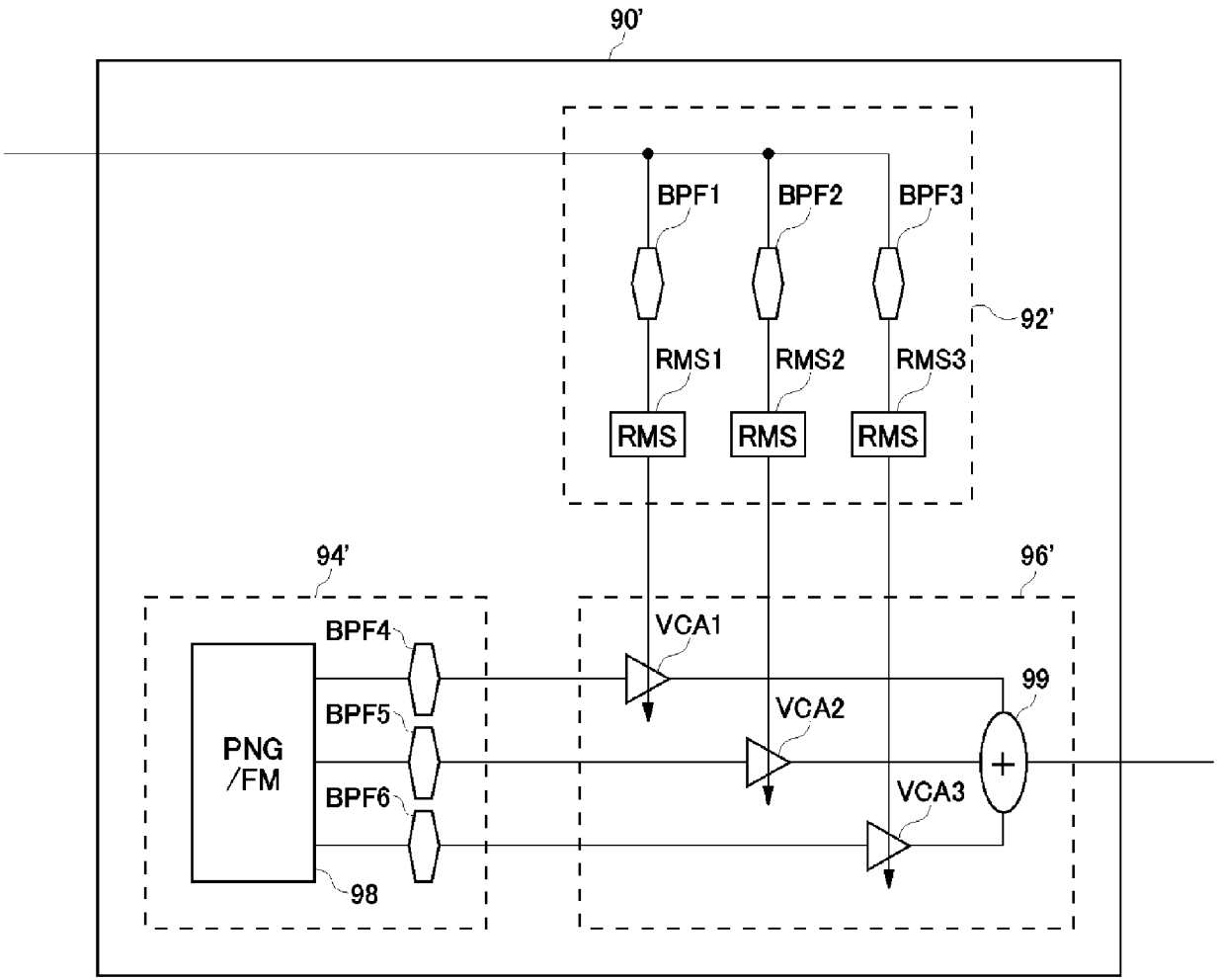
FIG. 6 is a block diagram that shows the functions and configuration of a part changing unit when noise based on maskee is used.

FIG. 6 is a block diagram that shows the functions and configuration of the part changing unit 90' when noise based on maskee H'(t) is used. The part changing unit 90' includes an envelope information acquisition unit 92', a replacement carrier generating unit 94', and an envelope information application unit 96'.

The envelope information acquisition unit 92' acquires, from a change target part signal extracted by the change target part extracting unit 30, the magnitude of each of multiple frequency components. The frequencies of the multiple frequency components are selected so that they differ from each other in a frequency range higher than the frequency of the envelope (amplitude component). Particularly, as such a frequency may be selected the center frequency of a 1/n octave band, which is obtained by dividing the frequency range of about 300 Hz to 5 kHz, i.e., a voice band, into octave bands and further dividing each octave band into a division number n (n is a natural number).

The envelope information acquisition unit 92' includes a first bandpass filter BPF1, a second bandpass filter BPF2, a third bandpass filter BPF3, a first RMS circuit RMS1, a second RMS circuit RMS2, and a third RMS circuit RMS3. BPF stands for Band Pass Filter, and RMS stands for Root Mean Square. FIG. 6 shows the case where an octave band in a voice band is divided into 3 (n=3). FIG. 6 shows components associated with a given octave band, and illustration related to the other octave bands is omitted therein. Also, n may be another value.

The first bandpass filter BPF1 is a ⅓-octave bandpass filter with a center frequency f1 and performs bandpass filtering on a change target part signal extracted by the change target part extracting unit 30. The first RMS circuit RMS1 generates a DC voltage according to the effective value of a signal subjected to the bandpass filtering by the first bandpass filter BPF1, such as a DC voltage that becomes higher when the effective value becomes greater.

The second bandpass filter BPF2 and the third bandpass filter BPF3 have the same configuration as the first bandpass filter BPF1, except that they each have a center frequency different from that of the first bandpass filter BPF1. The center frequency f1 of the first bandpass filter BPF1, the center frequency f2 of the second bandpass filter BPF2, and the center frequency f3 of the third bandpass filter BPF3 are different from each other. The center frequencies f1, f2, and f3 are selected from the frequency range of about 300 Hz to 5 kHz, as stated above, so that there will be no omitted bandwidth in signal extraction, i.e., so that neighboring bands (fi and fi±1) will be almost continuous. The intervals between the center frequencies fi need not be identical, and the center frequencies fi may be selected so that the center frequency and bandwidth of each filter satisfy the conditions stated above. The second RMS circuit RMS2 and the third RMS circuit RMS3 have the same configuration as the first RMS circuit RMS1.

The replacement carrier generating unit 94' includes a PNG/FM generating unit 98, a fourth bandpass filter BPF4, a fifth bandpass filter BPF5, and a sixth bandpass filter BPF6. PNG stands for Pink Noise Generator, and FM stands for Frequency Modulation.

The PNG/FM generating unit 98 functions as a sound source (signal source) in the replacement carrier generating unit 94' and generates pink noise or a deeply FM-modulated sine wave. The fourth bandpass filter BPF4 has a center frequency f4 that is identical with the center frequency of the first bandpass filter BPF1 (f4=f1) and performs bandpass filtering on a signal generated by the PNG/FM generating unit 98. Also, the fifth bandpass filter BPF5 has a center frequency f5 that is identical with the center frequency of the second bandpass filter BPF2 (f5=f2) and performs bandpass filtering on a signal generated by the PNG/FM generating unit 98. Further, the sixth bandpass filter BPF6 has a center frequency f6 that is identical with the center frequency of the third bandpass filter BPF3 (f6=f3) and performs bandpass filtering on a signal generated by the PNG/FM generating unit 98.

Although the center frequencies f1, f2, and f3 are identical with the center frequencies f4, f5, and f6, respectively, in the example described above, related center frequencies may be different from each other in order to improve the overall disturbing effects. Alternatively, different center frequencies may be related to each other by defining f1=f6, f2=f5, and f3=f4, for example.

Also, the bandwidths of the bandpass filters with the center frequencies f4, f5, and f6 may not necessarily be identical with those of the bandpass filters with the center frequencies f1, f2, and f3, respectively, used for extraction. For reliable frequency masking, wider bandwidths may be selected so that the bandwidths of the bandpass filters overlap each other on a frequency axis. The center frequencies f1, f2, and f3 of the bandpass filters used for extraction need not be set at regular intervals, as mentioned previously.

When a larger frequency component is acquired by the envelope information acquisition unit 92', the envelope information application unit 96' sets the corresponding frequency component of a replacement carrier generated by the replacement carrier generating unit 94' to be larger.

The envelope information application unit 96' includes a first VCA circuit VCA1, a second VCA circuit VCA2, a third VCA circuit VCA3, and an adder 99. VCA stands for Voltage Controlled Amplifier.

The first VCA circuit VCA1 is a voltage-controlled amplifier that amplifies a signal subjected to the bandpass filtering by the fourth bandpass filter BPF4, using a DC voltage generated by the first RMS circuit RMS1 as a control voltage. The first VCA circuit VCA1 is set to raise the gain for a higher control voltage. The second VCA circuit VCA2 is also a voltage-controlled amplifier that amplifies a signal subjected to the bandpass filtering by the fifth bandpass filter BPF5, using a DC voltage generated by the second RMS circuit RMS2 as a control voltage. The second VCA circuit VCA2 is also set to raise the gain for a higher control voltage. The third VCA circuit VCA3 is also a voltage-controlled amplifier that amplifies a signal subjected to the bandpass filtering by the sixth bandpass filter BPF6, using a DC voltage generated by the third RMS circuit RMS3 as a control voltage. The third VCA circuit VCA3 is also set to raise the gain for a higher control voltage.

The adder 99 adds a signal amplified by the first VCA circuit VCA1, a signal amplified by the second VCA circuit VCA2, and a signal amplified by the third VCA circuit VCA3 together. The part changing unit 90' outputs the resulting signal added by the adder 99 to the output unit 72. The output unit 72 then outputs the signal as the fifth sound signal S5 to the first loudspeaker 112 via the first power amplifier 110. Thereafter, the first loudspeaker 112 converts the fifth sound signal S5 into a sound and outputs the sound. Consequently, the resulting masker H(t) is superimposed on the maskee H'(t) to be heard and, since the spectrum and envelope of the masker H(t) are similar to those of the maskee H'(t), effective information disturbance is enabled.

Figure 7:
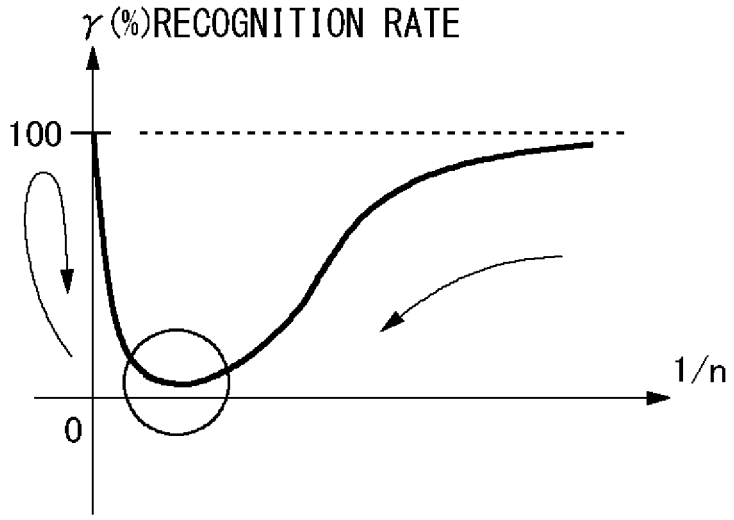
FIG. 7 shows a graph that schematically shows the relationship between a recognition rate and a division number.

The number of bandpass filters, n, into which an octave band is divided, may be determined based on FIG. 7 {n also corresponds to the division number n for the maskee H'(t)}. FIG. 7 shows a graph that schematically shows the relationship between a recognition rate γ and a division number n. In FIG. 7, the horizontal axis represents 1/n, and the vertical axis represents the recognition rate γ(%). The recognition rate γ(%) is defined as a recognition rate of independent words {(the number of independent words correctly recognized in conversation to be evaluated)/(the total number of independent words in the conversation)*100} when a listener listens to the masker H(t) or "the maskee H'(t) and the masker H(t)". The division number n may be determined so that the recognition rate γ(%) can be minimized in FIG. 7, for example.

In FIG. 7, when n is small, the bandwidth of each bandpass filter becomes wider, so that the masker H(t) becomes closer to noise. Accordingly, the difference from the maskee H'(t) becomes greater, so that the maskee H'(t) becomes distinguishable (information disturbance is not effectively performed and the recognition rate γ is increased). Meanwhile, when n is rather large, the masker H(t) overlaps with the maskee H'(t) to the extent that the masker H(t) cannot be distinguished in content from the maskee H'(t), so that the recognition rate γ becomes closer to 100%. Therefore, it is most difficult to distinguish the masker H(t) from the maskee H'(t) in a range where the masker H(t) is slightly shifted from the maskee H'(t), in which the recognition rate γ is decreased and the disturbing effect is maximized. The value of n at the time, i.e., when the recognition rate is minimized, is set to the optimum value of n. According to the frequency masking theory, a critical bandwidth Δf (a bandwidth of noise effectively masking pure tones) is defined as ¼ to ⅓ octave, and hence, n may be set to a value based thereon.

Although FIG. 6 shows the case where the part changing unit 90' uses noise based on the maskee H'(t) as another carrier component, the another carrier component may be accumulated original voice of the speaking person, modulated noise, voice of another person of the same or opposite gender, "helium voice", or the aforementioned HSL noise, as stated previously.

The accumulated original voice of the speaking person is accumulated data of original voice that has been spoken by the speaking person and used as a signal source of a spectrum for covering the spectrum of voice currently spoken by the speaking person.

When modulated noise is used, the replacement carrier generating unit 94 generates a replacement carrier by frequency-modulating a sine wave with a frequency equal to the center frequency of a filter (bandpass filter) instead of by using the filter. In this case, there is the advantage that the number of bandpass filters can be reduced by half.

When voice of another person of the same or opposite gender is used instead of accumulated original voice of the speaking person, the process of accumulating the original voice of the speaking person can be omitted while an effect similar to that of the original voice of the speaking person is obtained; accordingly, sound information disturbance is enabled from the beginning of speech by the speaking person or the beginning of a conversation. In the case of HSL noise, there is the advantage that the processed sound is acoustically more natural because HSL noise is similar to pink noise but generated from sound signals.

Helium voice is generated by using a technique for generating, electronically or by means of software, transformed voice obtained by speaking after inhalation of air containing a large amount of helium or by using a formant transformation technique for restoring the transformed voice. By using helium voice, an effect similar to that described above can be expected.

The description will now return to FIG. 4 again.

The output unit 72 acquires a new change target part signal from the part changing unit 90 and acquires signals other than the change target part from the change target part extracting unit 30. The output unit 72 then converts the signals to an analog signal and outputs the signal to the first loudspeaker 112 via the first power amplifier 110. The output unit 72 includes the delay adjusting unit 68 and a D/A unit 70.

The delay adjusting unit 68 connects a new change target part signal and signals other than the change target part so as to generate an output sound signal to be output. The delay adjusting unit 68 also adjusts timing at which the output sound signal is output from the output unit 72, based on the time required for the transmission of the maskee H'(t). Specifically, the delay adjusting unit 68 applies a predetermined delay to the output sound signal. The predetermined delay is set so that the delay of the masker H(t) with respect to the maskee H'(t) at the position of the listener 8 falls within a range in which it can be said that the maskee H'(t) and masker H(t) are delivered substantially in real time.

The maskee H'(t) and masker H(t) being delivered substantially in real time may mean that at least part of the masker H(t) is superimposed on the maskee H'(t) within the second booth 104, for example. It may also mean that a change target part signal output from the output unit 72 is converted into a sound by the first loudspeaker 112, and the converted sound is output to the second booth 104 while the maskee H'(t) is heard within the second booth 104. Further, it may also mean that a change target part signal output from the output unit 72 is converted into a sound by the first loudspeaker 112, and the converted sound is output to the second booth 104 while a part of the maskee H'(t) corresponding to the change target part signal is heard within the second booth 104. In other words, such a situation means that, on a part of the maskee H'(t) corresponding to a change target part signal, a part of the masker H(t) corresponding to the change target part signal is at least partially superimposed within the second booth 104.

When the acoustic system 100 is introduced, positions of a microphone and a loudspeaker are determined, and a supposed position of a customer and a supposed position of a listener are also determined to some degree. In addition, processing time in the SD controller SD can also be estimated to some degree. Accordingly, when the acoustic system 100 is introduced, the transmission time of maskee H'(t) from a customer to a listener and the transmission time of masker H(t) can be estimated to some degree. A delay applied by the delay adjusting unit 68 is determined by performing back calculation from a desired value of delay of the masker H(t) with respect to the maskee H'(t) at the listener's position.

If the delay of masker H(t) with respect to maskee H'(t) is large, an echo or reverberation may occur at the listener's position. Therefore, the delay adjusting unit 68 applies, to an output sound signal, a delay such that the delay of the masker H(t) with respect to the maskee H'(t) at the listener's position does not cause such incongruity. Although it may be determined through experiments, the delay to be applied is typically hundreds of milliseconds or less.

Depending on the positional relationships between the microphone, loudspeaker, customer, and listener, the masker H(t) may be delivered to the listener's position considerably later than the maskee H'(t) even when the delay adjusting unit 68 does not apply any delay. In such a case, the SD processing time in the SD controller SD must be reduced in order to synthesize the maskee H'(t) and masker H(t) substantially in real time at the listener's position so as to mask the information. For such a time constraint, i.e., the constraint of having to reduce the SD processing time, the accuracy of processing may have to be sacrificed. However, a purpose of the present embodiment is to reduce the clarity and recognition rate of sound and is not to raise the accuracy of supposed or expected processing. Therefore, the accuracy of processing does not matter greatly in the present embodiment, as long as the content of maskee H'(t) becomes incomprehensible by means of superimposition of masker H(t). This is because there are countless "conditions where the content of maskee H'(t) becomes incomprehensible" in the course of realizing the actual system.

The D/A unit 70 converts an output sound signal to which a delay has been applied by the delay adjusting unit 68 into the fifth sound signal S5, which is an analog signal for driving the first loudspeaker 112, and outputs the fifth sound signal S5 to the first power amplifier 110.

Flows of sounds and sound signals from the first loudspeaker 112 to the second sound changing unit 116 are similar to the flows shown in FIG. 3 and as described in relation thereto. Also, the configuration of the second sound changing unit 116 is similar to the configuration shown in FIGS. 3, 4, 5, 6, and 7 and as described in relation thereto.

When the first customer-side microphone 106*a* and the first counselor-side microphone 106*b* are regarded as a first sound collecting unit and the second customer-side microphone 114*a* and the second counselor-side microphone 114*b* are regarded as a second sound collecting unit in the acoustic system 100 according to the present embodiment, there is formed a sound loop, starting from the first sound collecting unit following the first sound changing unit 108, the first loudspeaker 112, the second sound collecting unit, the second sound changing unit 116, the second loudspeaker 120, and returning to the first sound collecting unit. However, in the acoustic system 100, the first sound transmission path 134 and the second sound transmission path 136 are set to have substantially the same length, and a differential sound signal Sc corresponding to a difference between the first sound signal S1 and the second sound signal S2 is input to the SD controller SD. Accordingly, the degree of sound attenuation is raised in the part between the second loudspeaker 120 and the first sound changing unit 108 within the above-mentioned loop. As a result, acoustic feedback or echoes caused by the loop can be restrained. Meanwhile, voices of the first customer 126 and the first counselor 124 are collected by the first sound collecting unit with almost no attenuation and input to the SD controller SD. Accordingly, the effect of reducing the clarity and recognition rate of sound by means of SD is maintained. Namely, in the acoustic system 100, the content of conversation can be effectively masked and prevented from leaking while acoustic feedback and echoes can be restrained.

In the acoustic system 100 according to the present embodiment, the degree of sound attenuation is raised also in the part between the first loudspeaker 112 and the second sound changing unit 116 within the aforementioned loop. Therefore, the effect of restraining acoustic feedback and echoes can be enhanced. In a system for preventing conversation from being known by others, as shown in FIG. 2, there are naturally formed two loudspeaker-air-microphone parts. The present embodiment uses both of such parts, thereby restraining acoustic feedback and echoes more effectively.

When a masking system is employed in a space where two or more speaking persons have a conversation, in order to prevent leakage of conversation, it is often difficult to collect sounds in a conversation with excellent S/N ratio by using only one microphone for multiple speaking persons.

For example, a meeting space or a consultation counter in a bank has a counter or a desk for work between speaking persons facing each other, so that the persons face each other at a certain distance. Also, there is a case where many people sit around a large table in a meeting space or the like. When only one microphone is used in such situations, the microphone needs to be placed at an equal distance from each speaking person; in addition, since ambient noise is also included, it is difficult to efficiently collect sounds in a conversation.

Also, when speaking persons face each other across a table, papers used for explanation or work are often spread out on the table, so that it is not practical to set up a microphone on the table. Thus, there are relatively few positions where a microphone can be placed to efficiently collect sounds. In a large space, including a conference room, voices can be equally collected when a microphone is placed at an equal distance from each speaking person, but the voice levels are lower because the microphone is distant from each speaking person. In addition, since ambient noise is also collected, the S/N ratio becomes smaller.

In the acoustic system 100 according to the present embodiment, on the other hand, multiple microphones are used, and each microphone is placed near a supposed position of a corresponding speaking person. Accordingly, voices of each speaking person in a conversation can be collected with excellent S/N ratio.

Figure 8:
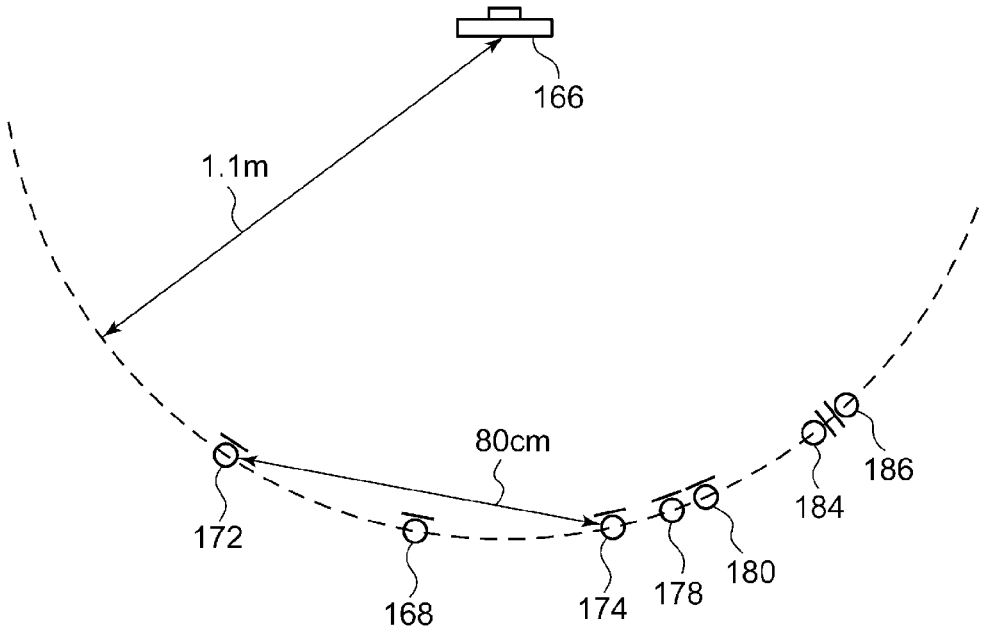
FIG. 8 is a schematic diagram that shows an experimental system for an experiment for recording a sound from a loudspeaker.
Figure 9:
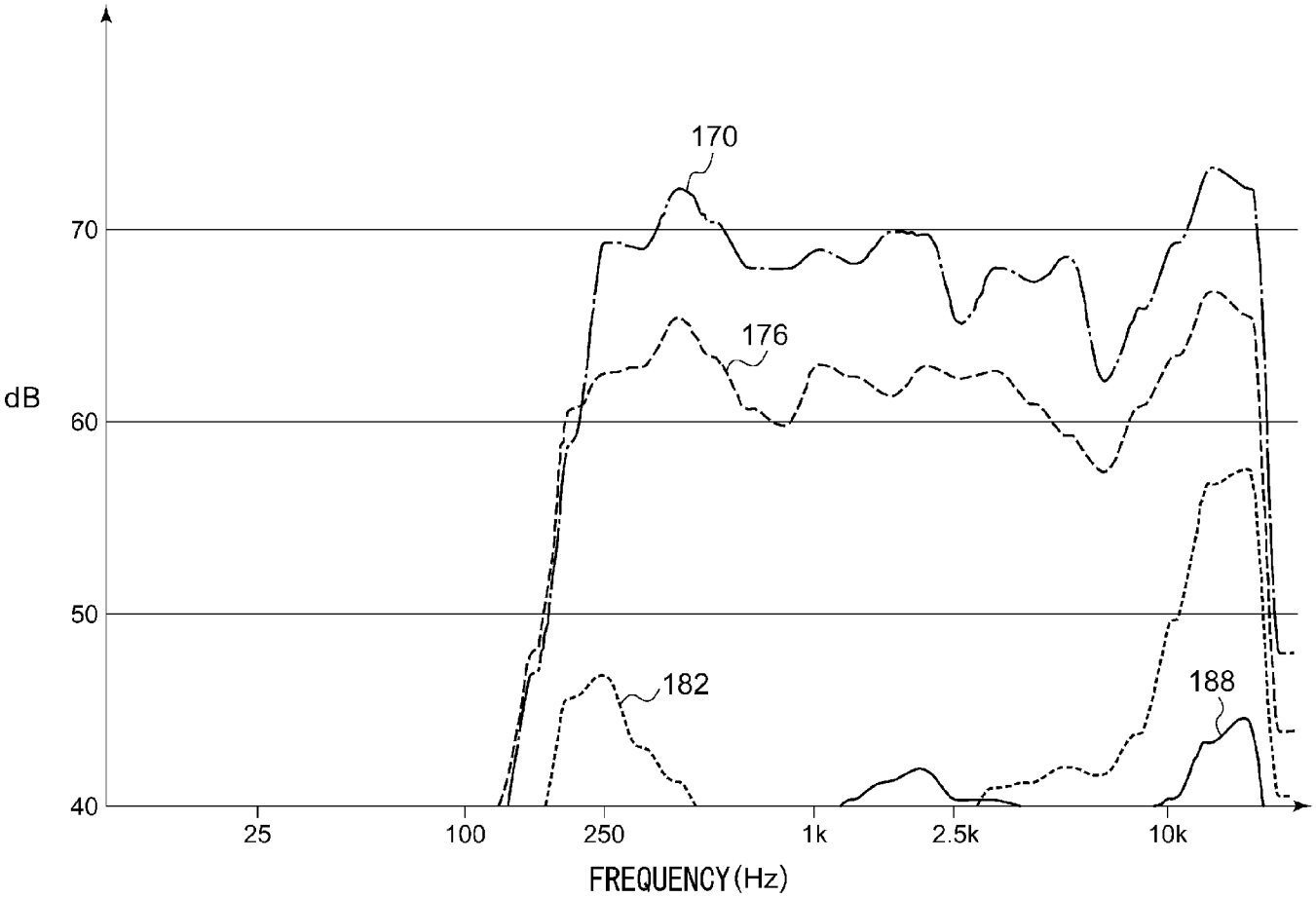
FIG. 9 shows frequency spectra that show the results of an experiment performed in the experimental system shown in FIG. 8.

The inventor conducted an experiment in which two microphones are arranged at an equal distance from a loudspeaker and connected in polar character so as to record a sound from the loudspeaker. FIG. 8 is a schematic diagram that shows an experimental system for an experiment for recording a sound from a loudspeaker 166. FIG. 9 shows frequency spectra that show the results of the experiment performed in the experimental system shown in FIG. 8. The largest spectrum in FIG. 9 is a frequency spectrum 170, which is a frequency spectrum of a signal generated by a microphone 168 when only the microphone 168 is used. Meanwhile, when a microphone 172 and a microphone 174 are arranged at an equal distance (1.1 m) from the loudspeaker 166 and with a distance of about 80 cm therebetween and when the microphone 172 and the microphone 174 are connected in polar character, the frequency spectrum of the resulting signal obtained by such connection is a frequency spectrum 176, which is smaller than the frequency spectrum 170. However, a voice of a speaking person is input to the nearest microphone in a high level and is little affected by the superimposition of a signal from the other microphone having an opposite phase and a low level. When two microphones 178 and 180 are arranged at the same position so that the both face the loudspeaker 166, the resulting frequency spectrum 182 becomes yet smaller. When two microphones 184 and 186 are arranged at the same position so that the both face each other, the resulting frequency spectrum 188 becomes further smaller.

The experimental results above show that, compared to the case where a single microphone is used, a reduction of about 4-8 dB (per channel) can be seen when two microphones are connected in polar characters. This means that the sounds from the loudspeaker 166 are made to have opposite phases, so that the sounds are cancelled out and the loop gain is reduced.

As an example of application of the present embodiment, it is assumed here that, in a consultation space in a bank or the like, a loudspeaker is mounted on a screen, and microphones are arranged near a bank clerk (microphone 1) and a customer (microphone 2), respectively, and at an equal distance from the loudspeaker.

Sounds transmitted from the loudspeaker to the microphones 1 and 2 have the same amplitude and the same phase, because the distances between the loudspeaker and the respective microphones are identical. However, by the presence of a transformer, the signals from the microphones 1 and 2, having the same amplitude, are set to have opposite phases and input to the system; consequently, the signals are cancelled out, so that the synthesized signal having a reduced level is input.

On the other hand, it is different when an input signal is based on a voice of a speaking person. For example, the distance between the microphone 2 near the customer (near the upper surface of the desk) and the mouth of the customer (signal source) is generally about 40 cm. Since the microphone 1 on the bank clerk side is placed across the desk, the distance between the microphone 1 and the customer may be about 120 cm. Accordingly, when the input level of a voice of the customer at the microphone 2 is about 55 dB, since the distance from the customer to the microphone 1 is about three times as long as the distance from the customer to the microphone 2, the input level of the voice of the customer at the microphone 1 is lower by about 9.5 dB than the input level at the microphone 2 according to the inverse-square law. Namely, the input from the customer to the microphone 1 is reduced to an ignorable level. In addition, since the input signals from the customer to the two microphones have different amplitudes and different phases and since the level of the input to the microphone 2 is superior while there is little input to the microphone 1, the signals are not cancelled out, and the signal level at the microphone 2 is input to the system nearly as it is. The same can be said for the microphone 1 on the bank clerk side.

By using such a microphone system, the level of a signal from the loudspeaker, which may cause acoustic feedback or echoes, can be lowered. Also, since microphones are placed near the respective speaking persons, a signal from a microphone near a speaking person is superiorly input to the system, so that a voice of the speaking person can be efficiently picked up.

With a single loudspeaker-air-microphone system, the signal level can be lowered by 4-8 dB; accordingly, combined with another loudspeaker-air-microphone system, twice the effect can be obtained, i.e., the signal level can be lowered by 8-16 dB, as a whole. This is because the loop is formed across the neighboring two systems in a figure eight shape.

The first customer-side microphone 106*a* and the first counselor-side microphone 106*b* may be placed so that the first sound transmission path 134 and the second sound transmission path 136 have substantially the same length, compared to the wavelength of a sound in the audible range.

A general audible range, 500 Hz to 3 kHz, corresponds to a range of about 11 to 68 cm in wavelength. Accordingly, since an acceptable error of the position of a microphone is often about a few millimeters, positioning of a microphone can be performed without any difficulty in such a level.

In the acoustic system 100 according to the present embodiment, the first sound transmission path 134 and the second sound transmission path 136 are set to have substantially the same length. If the lengths of the paths are different, a phase difference corresponding to the difference in path length will be caused between the seventh sound signal S7 and the tenth sound signal S10. Such a phase difference depends on the frequency of the sound. Accordingly, the phase difference ranges according to the frequency bands of sounds and, even when the difference between the seventh sound signal S7 and the tenth sound signal S10 is taken, the signals can hardly be cancelled out each other. Therefore, since such a phase difference, which varies according to the frequency of the sound, is not substantially caused, it is preferable to set the first sound transmission path 134 and the second sound transmission path 136 to have substantially the same length.

With the acoustic system 100 according to the present embodiment, conversation itself is not masked or eliminated in terms of loudness, but the content of the conversation, or information included in the sounds in the conversation is effectively masked. In this regard, the inventor has considered the following point.

In an open-plan office or at a lobby counter in a bank or a securities company, particularly at a service counter separated by simple partitions, when the content of conversation is made incomprehensible to a person uninvolved in the conversation, it is sufficient to accomplish the purpose of masking the content of conversation. Namely, the sound itself may be heard by another person, as long as the content of the conversation is not leaked. When the existence of the speaking person can be visually confirmed, it is even more natural that the spectrum or envelope (sound quality, intonation, or inflection) of the voice is kept. Accordingly, for the viewpoint and need described above, the acoustic system 100 according to the present embodiment enables masking of the content of conversation more naturally.

In the acoustic system 100 according to the present embodiment, the envelope information of a change target part signal extracted by the change target part extracting unit 30 is applied to another carrier component different from the carrier component of the change target part signal. Accordingly, the articulation of the resulting masker H(t) becomes similar to that of the maskee H'(t), providing less incongruity to the listener. Further, as previously described with reference to FIG. 7, the difference between the masker H(t) and the maskee H'(t) is given so that the effect of information disturbance becomes great, thereby enabling effective masking of conversation.

In the acoustic system 100 according to the present embodiment, a signal having a form of substantially one hill of energy envelope is extracted as a change target part signal by the change target part extracting unit 30. Accordingly, since cut and paste is performed on a part of maskee H'(t) where the signal level is low, click noise caused in SD processing can be reduced, for example. More specifically, when maskee H'(t) is continuous over time, masker H(t) thereof also becomes almost continuous; accordingly, click noise, which could be caused in a cutoff part when a signal is divided into predetermined time periods, or collapse of the shape of an envelope (collapse of intonation) due to windowing performed to reduce the click noise is less likely to occur.

Second Embodiment

In the first embodiment, two sound transmission paths are provided by using two microphones. In the second embodiment, on the other hand, two sound transmission paths are provided by using two loudspeakers.

Figure 10:
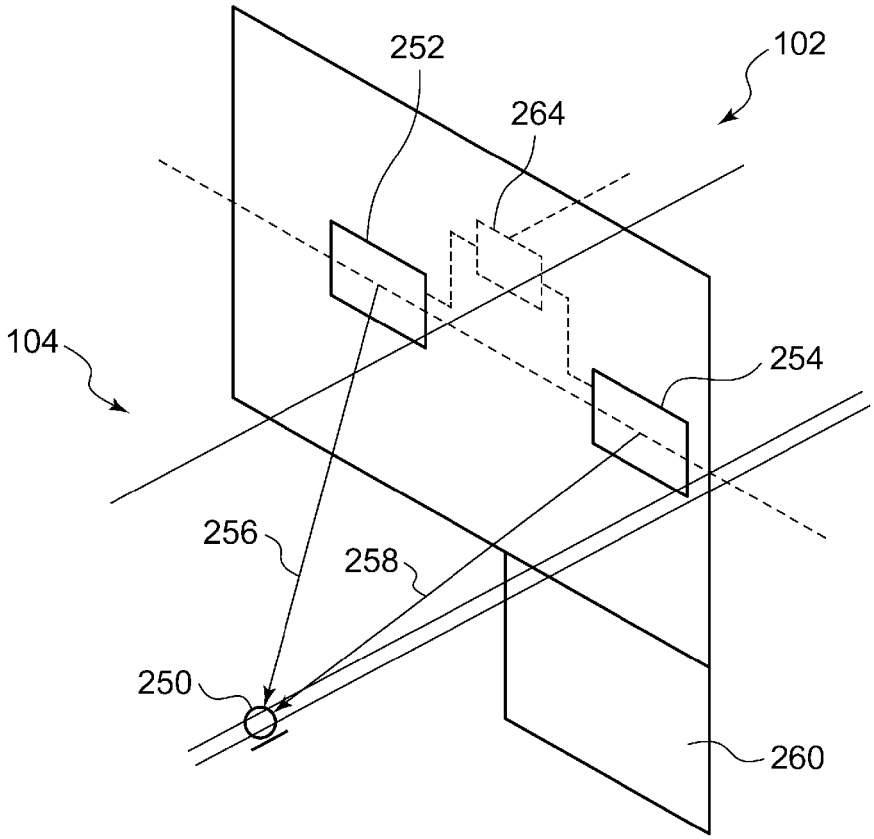
FIG. 10 is a schematic perspective view that shows a part of an acoustic system according to a second embodiment.

FIG. 10 is a schematic perspective view that shows a part of an acoustic system according to the second embodiment. In the acoustic system according to the present embodiment, two loudspeakers 252 and 254 are placed at a substantially equal distance from a microphone 250 (or at positions where physical conditions of the respective loudspeakers with respect to the microphone 250 become as similar to each other as possible). Each of the two loudspeakers 252 and 254 is mounted on a screen 260.

The acoustic system comprises a signal distribution unit 264 that generates, from a sound signal subjected to SD processing so as to be output to the second booth 104, two sound signals having phases substantially opposite to each other, outputs one of the two sound signals thus generated to the loudspeaker 252, and outputs the other sound signal to the loudspeaker 254. The signal distribution unit 264 is provided between the first sound changing unit 108 (not shown in FIG. 10) and the two loudspeakers 252 and 254. The two loudspeakers 252, 254 and the signal distribution unit 264 form a sound output unit. The two loudspeakers 252 and 254 output sounds having substantially opposite phases.

Since a fifth sound transmission path 256 between the microphone 250 and the loudspeaker 252 has a length substantially identical with that of a sixth sound transmission path 258 between the microphone 250 and the loudspeaker 254, two sounds having substantially opposite phases are input to the microphone 250. Accordingly, the sound signals from the two loudspeakers 252 and 254 are cancelled out and input to the microphone 250.

With the acoustic system according to the present embodiment, effects similar to those related to restriction of acoustic feedback and echoes and related to SD can be obtained, among the effects provided by the acoustic system 100 according to the first embodiment.

Acoustic systems according to embodiments have been described above. The embodiments are intended to be illustrative only, and it will be obvious to those skilled in the art that various modifications to a combination of constituting elements or processes could be developed and that such modifications also fall within the scope of the present invention. Further, embodiments can also be combined.

The first embodiment describes the case where the audio transformer 160 generates a differential sound signal Sc corresponding to a difference between the first sound signal S1 and the second sound signal S2; however, the operation is not limited thereto, and another electronic circuit may be used to generate a signal corresponding to a difference between the first sound signal S1 and the second sound signal S2. Alternatively, the first sound signal S1 and the second sound signal S2 may be digitized and input to a subtracting circuit.

In the first and second embodiments, the ceiling of a booth may be set higher or a sound absorbing material may be applied to the ceiling, in order to reduce the influence of sound transmission due to reflection. Alternatively, a screen may be made higher. Or another measure may be implemented, with the same physical conditions between a loudspeaker and a microphone, to reduce the influence of reflected sounds and reverberating sounds from the walls of the booth or the likes, such as making a screen longer so as to make a distance for which sound is routed around longer.

In the first and second embodiments, a graphic equalizer, a parametric equalizer, or a combination of a low-cut filter, a band-elimination filter, and a high-cut filter may be provided within the loop, so as to further reduce acoustic feedback and echoes.

In the first and second embodiments, a microphone having directivity may be used, such as a line microphone and a directional microphone.

Although the first embodiment describes the case where two microphones are provided for a single loudspeaker, the operation is not limited thereto. For example, in each of the two systems to be cancelled out, any number of microphones may be provided; also, any number of pairs of such two systems may be provided. Such configuration can cover the case where the space to be used or the sound correcting area is large. The respective microphones or systems are electronically added together, so that it is equivalent to the case where two microphones are provided for one speaker. The same applies to the second embodiment.

Although the first and second embodiments describe the case where the acoustic system 100 is mainly applied to a consultation counter in a bank, the application is not limited thereto. For example, the acoustic system 100 may be used in a relatively open space where speaking persons have a conversation, such as a telephone booth, a pharmacy, a work space separated by partitions in an office or the like, an open meeting space, a consultation desk for securities or insurance, a consultation desk in a department store or the like, and a coffee shop or a restaurant.

The acoustic system 100 may also be used to prevent leakage of conversation in a partitioned space like a private room where speaking persons have a conversation, such as a boardroom, a medical examination room, a conference room, a rental office, a banquet hall, a video conference room, and a partitioned office.

Further, the acoustic system 100 may be used between a space where a speaking person is present and a space where another speaking person is present (Local-to-Local) or between a space where a speaking person is present and a place where there may be an unspecified number of people, such as a waiting area and a hallway (Local-to-Public). The acoustic system 100 may also be used with a screen in an open office or the like, as needed, or may be used in a system having banquet halls or the likes adjacent to each other (Public-to-Public).

Figure 11:
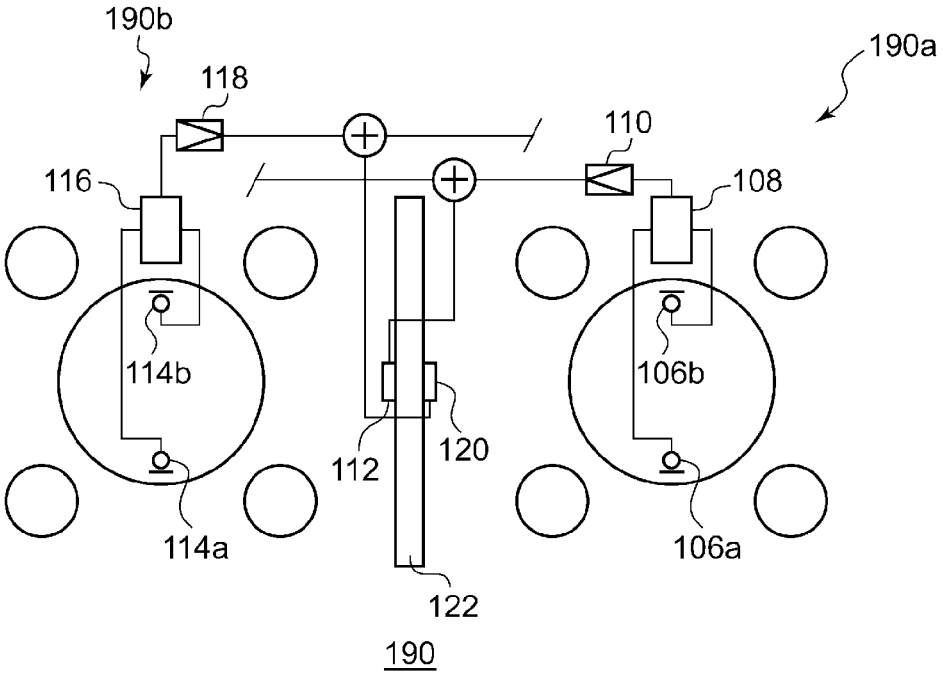
FIG. 11 is a schematic diagram that shows a configuration for the case where the acoustic system is applied to a banquet hall.

FIG. 11 is a schematic diagram that shows a configuration for the case where the acoustic system 100 is applied to a banquet hall 190. The banquet hall 190 is separated by a partition 122 into two small banquet halls 190*a* and 190*b*. By introducing the acoustic system 100, a person present in the small banquet hall 190*a* can hardly understand the content of conversation conducted in the other small banquet hall 190*b*. In addition, acoustic feedback and echoes can be adequately restrained.

Thus, the acoustic system 100 according to an embodiment can be used in various spatial forms, including Local-to-Local, Local-to-Public, and Public-to-Public.

Namely, in a space where information is transmitted by means of sound between multiple speaking persons or on the telephone, the acoustic system 100 according to an embodiment makes sound information in the space comprehensible in a limited area but makes the sound information incomprehensible out of the limited area, and the place where the acoustic system 100 is used is not particularly limited.

The first and second embodiments describe the case where two booths for which the acoustic system 100 is provided are located adjacent to each other; however, the situation is not limited thereto, and, if the sound in a conversation conducted in one booth or area can be heard by a person in the other booth or area, the booths need not necessarily be adjacent to each other.

Although the first and second embodiments describe the case where the acoustic system 100 is provided across two booths adjacent to each other, the number of booths or areas is not limited to two. For example, in a system including three or more booths or areas, the acoustic system 100 may be used in arbitrary two booths or areas thereof.

Although the first and second embodiments describe the case where the sound transmission path between a loudspeaker and a microphone is defined as a path obtained by connecting the loudspeaker and microphone with a straight line, the application is not limited thereto. For example, if there is an obstacle on the straight line between the loudspeaker and microphone, the transmission path will be a path through which sound is routed around the obstacle.

What is claimed is:

1. An acoustic system comprising:

a first sound collecting unit configured to receive a sound and generate a sound signal representing the sound;

a sound changing unit configured to change a sound signal generated by the first sound collecting unit;

a first sound output unit configured to convert a sound signal changed by the sound changing unit into a sound and to output the sound to a second area different from a first area where the first sound collecting unit is placed;

a second sound collecting unit placed in the second area and configured to receive a sound and generate a sound signal representing the sound; and a second sound output unit configured to output, to the first area, a sound based on a sound signal generated by the second sound collecting unit, wherein:

between the first sound output unit and the second sound collecting unit are provided a first sound transmission path and a second sound transmission path having substantially the same length;

a sound signal corresponding to a sound transmitted through the first sound transmission path is made to have a phase substantially opposite to that of a sound signal corresponding to a sound transmitted through the second sound transmission path before the sound signals are added together, wherein the sound changing unit includes:

an amplitude waveform extracting unit configured to extract a waveform of an amplitude component along a time axis, from a sound signal generated by the first sound collecting unit;

a part extracting unit configured to extract a change target part signal from a sound signal generated by the first sound collecting unit, on the basis of a waveform extracted by the amplitude waveform extracting unit;

a part changing unit configured to prepare another carrier component different from the carrier component of a change target part signal extracted by the part extracting unit and to apply a waveform of an amplitude component of the change target part signal along a time axis to the another carrier component so as to obtain a new change target part signal; and an output unit configured to output, to the first sound output unit, a new change target part signal obtained by the part changing unit.

2. The acoustic system according to claim 1, wherein the part changing unit prepares another carrier component independent of the carrier component of a change target part signal extracted by the part extracting unit and applies a waveform of an amplitude component of the change target part signal along a time axis to the another carrier component so as to obtain a new change target part signal.

3. The acoustic system according to claim 1, wherein the part extracting unit designates, as the change target part signal, a signal having a form of substantially one hill of energy envelope in a section delimited by a first time before a peak in a waveform extracted by the amplitude waveform extracting unit and a second time after the peak.

4. The acoustic system according to claim 1, further comprising a timing adjusting unit configured to adjust timing at which the output unit outputs a new change target part signal obtained by the part changing unit, in accordance with the time required for the transmission of sound from the first area to the second area.

5. The acoustic system according to claim 1, wherein the part changing unit includes:

an envelope information acquisition unit configured to acquire, from a change target part signal extracted by the part extracting unit, the magnitude of each of a plurality of frequency components;

a replacement carrier generating unit including a plurality of bandpass filters to which signals from a sound source are input; and an envelope information application unit configured to change the magnitude of a signal output from each of the bandpass filters in accordance with the magnitude of a corresponding frequency component among the plurality of frequency components.

6. The acoustic system according to claim 5, wherein the center frequency of a bandpass filter included in the replacement carrier generating unit is different from the frequency of a corresponding frequency component among the plurality of frequency components.

* * * * *